US009433841B2

(12) United States Patent
Siefker

(10) Patent No.: US 9,433,841 B2
(45) Date of Patent: Sep. 6, 2016

(54) HYBRID GOAL SHOT TRAINING SYSTEMS AND DEVICES

(71) Applicant: Aaron Glenn Siefker, Newport Beach, CA (US)

(72) Inventor: Aaron Glenn Siefker, Newport Beach, CA (US)

(73) Assignee: Zero Nine Products, LLC, Corona del Mar, CA (US)

( * ) Notice: Subject to any disclaimer, the term of this patent is extended or adjusted under 35 U.S.C. 154(b) by 0 days.

(21) Appl. No.: 14/246,438

(22) Filed: Apr. 7, 2014

(65) Prior Publication Data

US 2015/0283441 A1 Oct. 8, 2015

(51) Int. Cl.

| | |
|---|---|
| ***A63B 69/00*** | (2006.01) |
| ***A63B 63/00*** | (2006.01) |
| *A63B 71/06* | (2006.01) |

(52) U.S. Cl.

CPC ..... *A63B 63/004* (2013.01); *A63B 63/00* (2013.01); *A63B 69/002* (2013.01); *A63B 69/0026* (2013.01); *A63B 2063/001* (2013.01); *A63B 2071/0694* (2013.01); *A63B 2209/00* (2013.01); *A63B 2243/0025* (2013.01); *A63B 2243/0045* (2013.01)

(58) Field of Classification Search

CPC ..... A63B 63/00; A63B 69/3623; A63B 24/0021; A63B 63/008; A63B 69/0097

USPC ..... 473/422, 438, 446, 454, 470, 471, 477, 473/478, 434, 435

See application file for complete search history.

(56) References Cited

U.S. PATENT DOCUMENTS

| | | | | |
|---|---|---|---|---|
| 227,262 A | | 5/1880 | Kendall | |
| 364,805 A | | 6/1887 | Conboy | |
| 1,615,931 A | | 2/1927 | Cann | |
| 2,033,408 A | | 3/1936 | Watterson | |
| 3,426,363 A | | 2/1969 | Girard | |
| 3,558,140 A | | 1/1971 | Romeo | |
| 3,563,544 A | * | 2/1971 | Hedrick | A63B 63/00 473/435 |
| 3,840,228 A | | 10/1974 | Greaney | |
| 3,994,423 A | | 11/1976 | Burg | |

(Continued)

FOREIGN PATENT DOCUMENTS

CA 1227818 10/1987

OTHER PUBLICATIONS

Webpage Download, chinatexnet2009, 2009, www.chinatexnet.com/Global/Buying-Leads/Buy-100-polyester-hexagonal-mesh-fabric-62202.html, 1 page.

(Continued)

*Primary Examiner* — Mitra Aryanpour

(74) *Attorney, Agent, or Firm* — Eric L. Lane; Green Patent Law

(57) ABSTRACT

Hybrid goal shot training systems and devices comprise a hybrid training panel including a cover portion and at least one net portion connected to the cover portion. The cover portion is composed of a material creating negative space by obscuring visual access behind the cover portion. The cover portion has a top edge, a bottom edge, and side edges. The net portion defines multiple net openings and allows visual access of positive space behind the net portion. The training device may further comprise a band of brightly colored material running along at least one side edge and a top or bottom edge of the cover portion. The hybrid training panel may be a unitary device having a one-piece construction. The device may comprise four net portions located at four corners of the hybrid training panel.

19 Claims, 20 Drawing Sheets

(56) References Cited

U.S. PATENT DOCUMENTS

| | | | | |
|---|---|---|---|---|
| 4,173,337 | A | 11/1979 | Okonowski | |
| 4,212,288 | A | 7/1980 | Lipinski | |
| 4,258,923 | A | 3/1981 | Senoh | |
| 4,864,698 | A | 9/1989 | Brame | |
| 4,921,257 | A | 5/1990 | Heller | |
| D309,486 | S | 7/1990 | Guenette et al. | |
| 4,948,147 | A * | 8/1990 | Pallanca | 473/478 |
| 4,963,410 | A | 10/1990 | Bryant | |
| 5,054,507 | A | 10/1991 | Sparks | |
| 5,181,725 | A | 1/1993 | Leras et al. | |
| 5,280,904 | A * | 1/1994 | Rodriguez | 473/477 |
| 5,306,009 | A * | 4/1994 | Bolanos | A63B 63/00 473/194 |
| 5,427,381 | A * | 6/1995 | Macaluso | A63B 63/004 473/446 |
| 5,503,402 | A | 4/1996 | Moss, Jr. | |
| 5,603,591 | A | 2/1997 | McLellan | |
| 5,634,640 | A | 6/1997 | McCarrel | |
| 5,725,444 | A | 3/1998 | Heden | |
| 5,730,442 | A | 3/1998 | Anderson | |
| 5,895,330 | A | 4/1999 | Reilly, Jr. | |
| 5,902,194 | A | 5/1999 | Wade | |
| D411,267 | S | 6/1999 | Oudemool et al. | |
| 6,264,572 | B1 | 7/2001 | Matheson et al. | |
| 6,508,729 | B1 | 1/2003 | Coltrane et al. | |
| 6,595,878 | B1 | 7/2003 | Nelson | |
| 6,659,892 | B2 | 12/2003 | Lytle et al. | |
| 6,846,253 | B1 | 1/2005 | Szwalek | |
| 6,893,364 | B1 | 5/2005 | Grunfeld | |
| 6,926,624 | B1 | 8/2005 | Witzke | |
| 6,991,566 | B1 * | 1/2006 | McKinney, Sr. | A63B 63/00 473/435 |
| 7,037,219 | B2 | 5/2006 | Pakieser | |
| 7,468,009 | B1 * | 12/2008 | Ball | A63B 63/0097 473/435 |
| D585,949 | S * | 2/2009 | Gaudin | D21/705 |
| 7,578,757 | B1 | 8/2009 | McNary | |
| 7,648,421 | B2 * | 1/2010 | Yoon | A63B 63/00 473/197 |
| 7,651,416 | B2 | 1/2010 | Farquhar | |
| 7,661,679 | B2 | 2/2010 | Mah et al. | |
| 7,811,184 | B2 | 10/2010 | Siefker | |
| 8,079,923 | B2 | 12/2011 | Siefker | |
| 8,246,494 | B2 * | 8/2012 | Stephenson | A63B 63/004 473/422 |
| 8,430,771 | B1 * | 4/2013 | Berghammer et al. | 473/477 |
| 8,961,339 | B2 * | 2/2015 | Littman et al. | 473/435 |
| 2002/0151387 | A1 * | 10/2002 | Henson | 473/446 |
| 2003/0228941 | A1 | 12/2003 | Bains | |
| 2004/0235589 | A1 | 11/2004 | Wedgbury | |
| 2004/0259667 | A1 | 12/2004 | Berdugo et al. | |
| 2005/0049089 | A1 | 3/2005 | Pakieser | |
| 2006/0273522 | A1 | 12/2006 | Marshall et al. | |
| 2007/0191141 | A1 | 8/2007 | Weber | |
| 2007/0265115 | A1 | 11/2007 | Farquhar | |
| 2008/0032826 | A1 | 2/2008 | Mubarak et al. | |
| 2009/0181810 | A1 | 7/2009 | Stephenson | |
| 2010/0081513 | A1 * | 4/2010 | La Pointe | 473/478 |
| 2011/0201457 | A1 * | 8/2011 | Cosper | A63B 63/00 473/416 |
| 2012/0077628 | A1 | 3/2012 | Siefker | |
| 2013/0023362 | A1 | 1/2013 | Siefker | |
| 2014/0087894 | A1 | 3/2014 | Siefker | |
| 2015/0057113 | A1 * | 2/2015 | Phillips | A63B 63/004 473/478 |
| 2016/0016060 | A1 * | 1/2016 | Goldwitz | A63B 69/00 473/446 |

OTHER PUBLICATIONS

Webpage Download, Soccergoals2014, Various Screenshots of goals and netting, Dates vary, 10 pages.

Webpage Download, Walmart2009, 2009, reviews.walmart.com/1336/11045440/mitre-6-x-4-3-in-1-soccer-trainer-reviews/reviews.htm, 2 pages.

Webpage Download, Cascadenets2004, 2004, Cascadenets2004 web.archive.org/web/20040820182908/http://cascadenets.com/barrier_netting.php, 3 pages.

Webpage Download, plasticmesh, 2008 web.archive.org/web/20080705083216/http://www.plasticmesh.net/plasticmesh/debris-safety-netting.html, 3 pages.

Webpage Download, gourock, 2009, web.archive.org/web/20101115155306/http://www.gourock.com/hbns.html, 9 pages.

Webpage Download, Badinotti, 2008, www.badinotti.com/how_to_measure_meshes.html, 14 pages.

Webpage Download, CooleyGroup, 2009, http://cooleygroup.com/cooley_product/coolmesh, 6 pages.

Webpage Download, Funtec, http://www.funtec.co.uk/frames/beach-volleyball-frameset.html, 2 pages.

International Search Report and Written Opinion in related PCT Application No. PCT/US2013/058792.

Franklin Tournament Soccer Rebounder, available at http://www.hayneedle.com/product/tournamentrebounder.cfm.

Lion Sports Heavy Duty Soccer Rebounder, available at http://www.hayneedle.com/product/lionsportsheavydutysoccerrebounder12x6ft.cfm.

Lion Sports 3 in 1 Soccer Trainer, available at http://www.hayneedle.com/product/lionsports3in1soccertrainer.cfm.

Primed 7' X 5' Soccer Trainer, available at http://www.dickssportinggoods.com/product/index/jsp?productId=20916406.

* cited by examiner

HYBRID GOAL SHOT TRAINING SYSTEMS AND DEVICES

FIELD OF THE DISCLOSURE

The following disclosure relates to goal shot training systems and devices. More particularly, this disclosure relates to hybrid goal shot training systems and devices.

BACKGROUND

There are many different sports which involve shooting a ball, puck, or other object into a goal to score points. Such sports, including, but not limited to, soccer, hockey, lacrosse, and water polo, are often big business at the professional and collegiate levels. Accordingly, training players of these sports to improve their skills in scoring goals can be very important to the success of the teams and to the sports businesses' bottom lines.

One way to improve a player's goal shooting ability is to practice shooting with some form of goal training device attached to a goal. Such goal training devices provide targets to aim for and/or a goal cover that rebounds the ball, puck, or other object back to the player so he or she can practice repeated shots. However, most existing goal training devices do not provide a critical feature that is proven to improve a player's goal shooting ability, i.e., a sufficient visual distinction between the training device and the net of the goal.

This visual distinction, manifested in negative viewing space—a color or visual appearance darker than the net so as to obscure the net—and one or more positive viewing spaces—spaces through which the net is easily visible in contrast to the negative viewing space—is very effective in training a player to shoot the ball, puck, or other object at areas of the goal where scoring is more likely. Thus, there is a need for a goal training device that provides a visual distinction using negative and positive viewing spaces.

Another disadvantage of existing goal training devices is that they need a large amount of durable material to extend across the net and effectively rebound the ball, puck, or other object. Thus, the devices can be expensive to manufacture and have a high price point as a result. Therefore, there is a need for a goal training device that is made of less material so it is cheaper to manufacture, yet maintains good durability.

Many of the aforementioned sports are played outside and are therefore subject to the elements, particularly wind. Another disadvantage of existing goal training devices, even those that utilize positive and negative viewing spaces, is that the solid material used for a goal cover is blown by wind and therefore does not maintain its original position in windy conditions. Thus, there is a need for a goal training device that maintains its position in windy conditions.

In addition, there are a number of temporary goals designed for ease of storage, transport, and set-up, some specifically designed for children and for recreation. Many of these goals for recreational use are quite small relative to professional goals and some have a substantially flat configuration. Existing goal training devices are either too large for the small goals and/or too bulky or otherwise inoperable in conjunction with flat goals. Accordingly, there is a need for a goal shot training device that can be used with small goals and flat goals, and can be used in place of an ordinary net in a flat goal.

Accordingly, there is a need for a goal training device that provides a visual distinction using negative and positive viewing spaces. There is also a need for a goal training device that is made of less material so it is cheaper to manufacture, yet maintains good durability. Moreover, there is a need for a goal training device that maintains its position in windy conditions. Finally, there is a need for a goal training device that can be used with small goals and flat goals and can create a visual distinction as part of an integrated device. In sum, there is a need for a goal training device that uses negative and positive viewing space to provide a sufficient visual distinction between the device and the areas where the player is to be trained to direct shots while also using less material, maintaining its position in windy conditions, and working in conjunction with small goals and substantially flat goals.

SUMMARY

The present disclosure, in its many embodiments, alleviates to a great extent the disadvantages of known goal training devices by providing goal shot training systems and devices wherein a hybrid training panel includes a cover portion and at least one net portion such that the cover portion creates negative space by obscuring visual access behind the cover portion and the net portion allows visual access of positive space behind the net portion. Disclosed devices, systems and methods advantageously use negative and positive space to provide a sufficient visual distinction between the device and the net of the goal while also using less material and maintaining the position of the device in windy conditions. Such devices and systems are used to condition soccer players to make shots at the goal with an improved likelihood of scoring by teaching the soccer players to aim towards the areas of the goal where shots are more likely to score.

Exemplary embodiments of a hybrid goal shot training device comprise a hybrid training panel including a cover portion and at least one net portion connected to the cover portion. The cover portion is composed of a material creating negative space by obscuring visual access behind the cover portion. The cover portion has a top edge, a bottom edge, and side edges. The net portion defines multiple net openings and allows visual access of positive space behind the net portion.

In exemplary embodiments, the material of the cover portion is a knit material defining multiple knit openings. The material of the cover portion may be of a color that creates a visual contrast with the net portion. In exemplary embodiments, the material of the cover portion may be a solid material. The training device may further comprise a band of brightly colored material located where the at least one net portion is connected to the cover portion.

In exemplary embodiments, the hybrid training panel is a unitary device having a one-piece construction. In exemplary embodiments, the cover portion is substantially cross-shaped. The at least one net portion may comprise four net portions located at four corners of the hybrid training panel. The cover portion may be substantially rectangular. The at least one net portion may comprise two net portions located at opposite sides of the hybrid training panel.

An exemplary embodiment of a hybrid goal shooting training system comprises a hybrid training panel including a cover portion and at least one net portion connected to the cover portion. The hybrid training panel is adapted to be used in combination with a goal frame. In exemplary embodiments, the cover portion is composed of a material creating negative space by obscuring visual access behind the cover portion. The system may further comprise a net affixed to the goal frame, and the cover portion obscures a majority of the net from view. The cover portion may have a top edge, a bottom edge, and side edges. The net portion is connected to the cover portion, defines multiple net openings, and allows visual access of positive space behind the net portion.

In exemplary embodiments, the hybrid training panel is a unitary device having a one-piece construction. The material of the cover portion may be a knit material defining multiple knit openings. In exemplary embodiments, the knit openings are substantially teardrop-shaped. The material of the cover portion may be of a color that creates a visual contrast with the net portion.

In exemplary embodiments, the at least one net portion comprises four net portions located at four corners of the hybrid training panel. The cover portion may be substantially cross-shaped. In exemplary embodiments, the at least one net portion comprises two net portions located at opposite sides of the hybrid training panel, and the cover portion is substantially rectangular. In exemplary embodiments, the at least one net portion comprises at least five net portions.

Accordingly, it is seen that goal shot training devices and systems are provided. The disclosed devices and systems use negative and positive space to provide a sufficient visual distinction between the device and the net of the goal by providing a hybrid training panel that includes a cover portion and at least one net portion connected to the cover portion such that the cover portion creates negative space by obscuring visual access behind the cover portion and the net portion allows visual access of positive space behind the net portion. These and other features and advantages will be appreciated from review of the following detailed description, along with the accompanying figures in which like reference numbers refer to like parts throughout.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
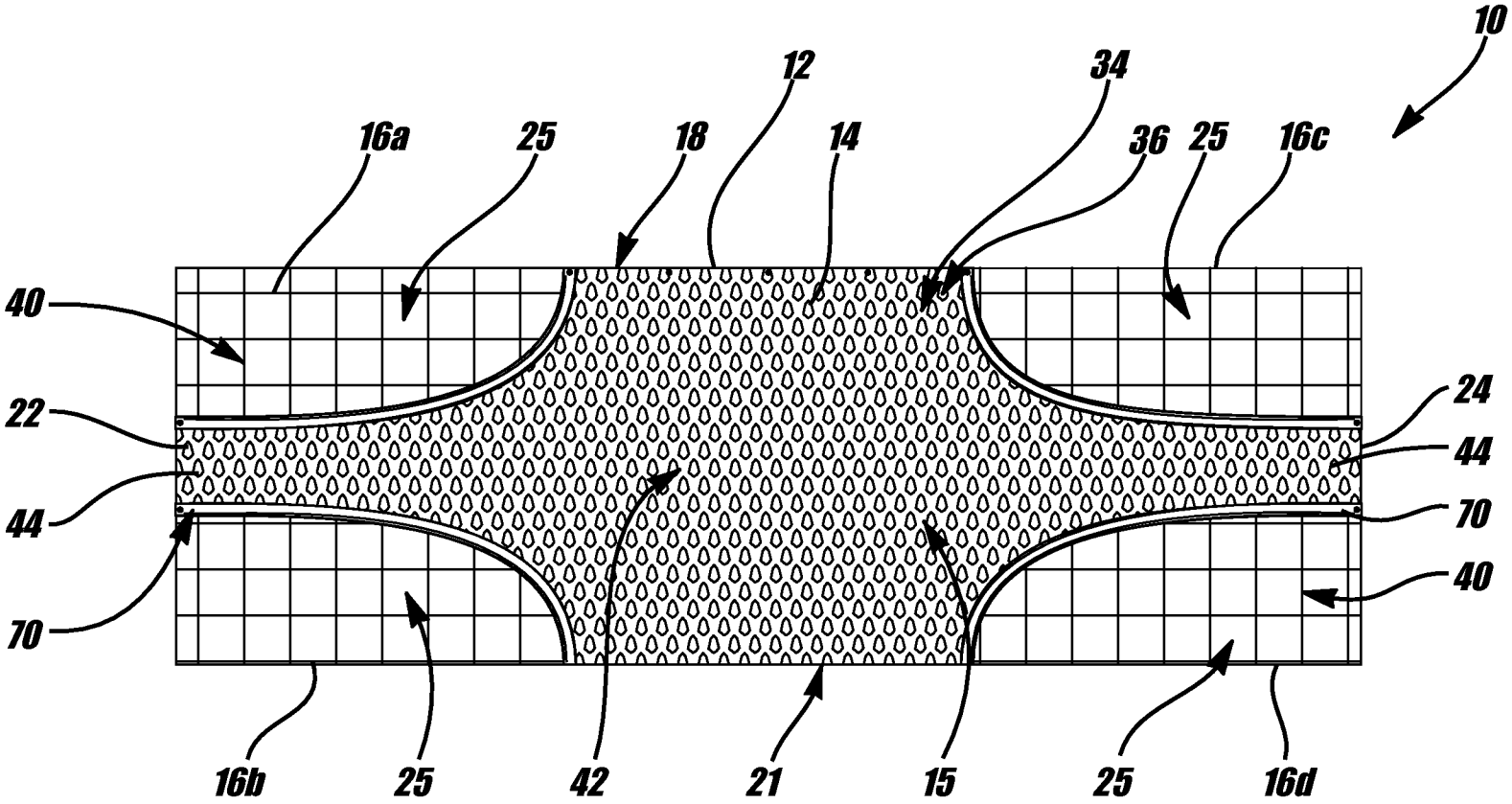
FIG. 1 is a front view of an exemplary embodiment of a hybrid goal shot training device in accordance with the present disclosure.

In the following detailed description of embodiments of the disclosure, reference is made to the accompanying drawings in which like references indicate similar elements, and in which is shown by way of illustration specific embodiments in which disclosed systems and devices may be practiced. These embodiments are described in sufficient detail to enable those skilled in the art to practice the embodiments, and it is to be understood that other embodiments may be utilized and that logical, mechanical, functional, and other changes may be made without departing from the scope of the present disclosure. The following detailed description is, therefore, not to be taken in a limiting sense, and the scope of the present disclosure is defined by the appended claims. As used in the present disclosure, the term "or" shall be understood to be defined as a logical disjunction and shall not indicate an exclusive disjunction.

The term "negative space" or "negative viewing space" as used in this application refers to a color or visual appearance darker than the net and/or darker than the net portions of the training device and/or otherwise creating a visual distinction with the net and/or net portions of the training device so as to obscure the space behind the training device from view by a player using disclosed embodiments of goal shot training systems and devices. The term "positive space" or "positive viewing space" as used in this application refers to a region of a goal that a player aims for when shooting and can see as spaces behind the one or more net portions that are easily visible in contrast to the negative viewing space.

Players of soccer, lacrosse, water polo, hockey and other sports train with the end goal of scoring goals by moving a ball, puck or other object into a goal. The goal is a target typically defined by two posts and a cross bar connecting the posts. The posts of a regulation soccer goal are 24 feet apart, and the cross bar is 8 feet high. Goals for other sports such as hockey, polo, and lacrosse and recreational goals for soccer may be substantially smaller. Typically, a net is hung behind the goal to stop the ball, puck or other object and more easily determine when a goal is scored.

Soccer players, with the exception of the goalkeeper, may use any part of their body except for their arms and hands to move the ball towards the goal. The goalkeeper comprises the last defense and may use any part of their body, including their arms and hands, to prevent the opposing players from scoring a goal. The goalkeeper is positioned in front of the goal and presents an obstacle that opposing players must overcome.

In soccer, the ball typically is moved into the goal by kicking the ball or by striking the ball with the head—"heading the ball." Soccer players develop the ability to precisely shoot the ball though the goal. In order to strike the ball with precision and hard enough to evade the goalkeeper, the players often "set up the shot." To set up the shot, the player looks up to the goal to aim the shot and decide how the ball will be struck. Thereafter, the soccer player looks down at the ball immediately prior to kicking it to accurately strike the ball, allowing the player to vary the spin and vertical elevation of the shot. The entire process may take less than a second. Thus, most of the "decisions" involved in setting up the shot are instinctive as a result of long hours of practice.

The process of looking up and taking aim occurs in a relatively short period of time. Players must therefore train to rapidly recognize and make adjustments to their shots in short time periods of often less than a second. Players' eyes tend to be attracted first to the movement of the goalkeeper after setting up the shot. Because players tend to shoot the ball, puck, or other object at the first object they see in the goal area, they tend to shoot the ball directly at the goalkeeper, the area where the player is least likely to score a goal. However, if soccer players are trained to first see a different part of the goal where the likelihood of scoring is increased, the players will have a better likelihood of scoring. For example, if a soccer player trains to see to the corners of the goal first after setting up the shot, rather than seeing the goalkeeper first, the likelihood of scoring a goal is greatly increased. Thus, a new method of training soccer players is needed, which helps condition players to see a higher likelihood of scoring areas of the goal first and to shoot at these areas.

The present disclosure is designed to train players of any sport where points are scored by directing a ball, puck or other object into a goal to see parts of the goal in which the player is most likely to score. The systems and methods of the present disclosure deemphasize the areas covered by the goalkeeper using negative viewing spaces and emphasize the areas in which players are most likely to score goals using positive viewing spaces. Consequently, when a soccer player, hockey player, lacrosse player, polo player, etc. looks up to the goal after setting up the shot, the player becomes conditioned to see the areas most likely to score a goal and will consequently shoot the ball towards those areas rather than at the goalkeeper.

Figure 2:
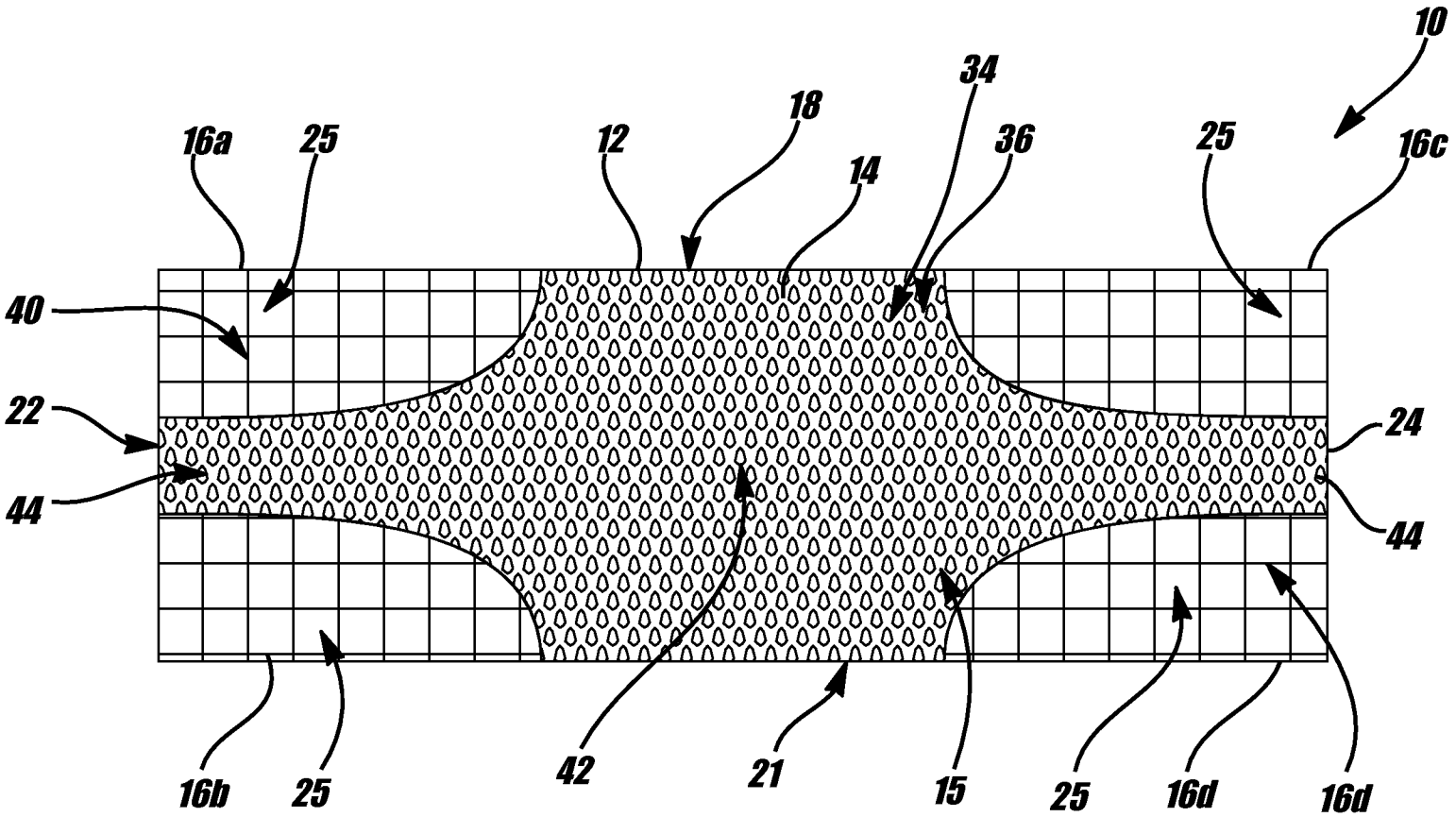
FIG. 2 is a front view of an exemplary embodiment of a hybrid goal shot training device in accordance with the present disclosure.

An exemplary embodiment of a hybrid goal shot training device is shown in FIGS. 1 and 2. Hybrid goal shot training device 10 comprises a hybrid training panel 12 including a cover portion 14 and at least one net portion 16 connected to the cover portion 14. The cover portion 14 has a top edge 18, a bottom edge 21, and first and second side edges 22, 24. As discussed in more detail herein, the cover portion 14 is made of a material that creates negative space 15 by obscuring visual access behind it. At the same time, the net portions 16 allow visual access of positive space 25 behind them. As discussed in more detail herein, the cover portion 14 may have side extensions 44 that roughly imitate the range of a goal keeper's arms, and a band 70 of material may be provided at the boundaries between the cover portion 14 and the one or more net portions 16. Exemplary embodiments have four net portions 16*a*, 16*b*, 16*c*, and 16*d*, with each net portion connected to the cover portion 14 at a respective corner of the cover portion. Some such embodiments of a training device include a cover portion 14 that is roughly cross-shaped to imitate the range over which a goalkeeper is likely to make a save. However, exemplary embodiments may have two or even one net portion, as discussed herein.

Figure 3:
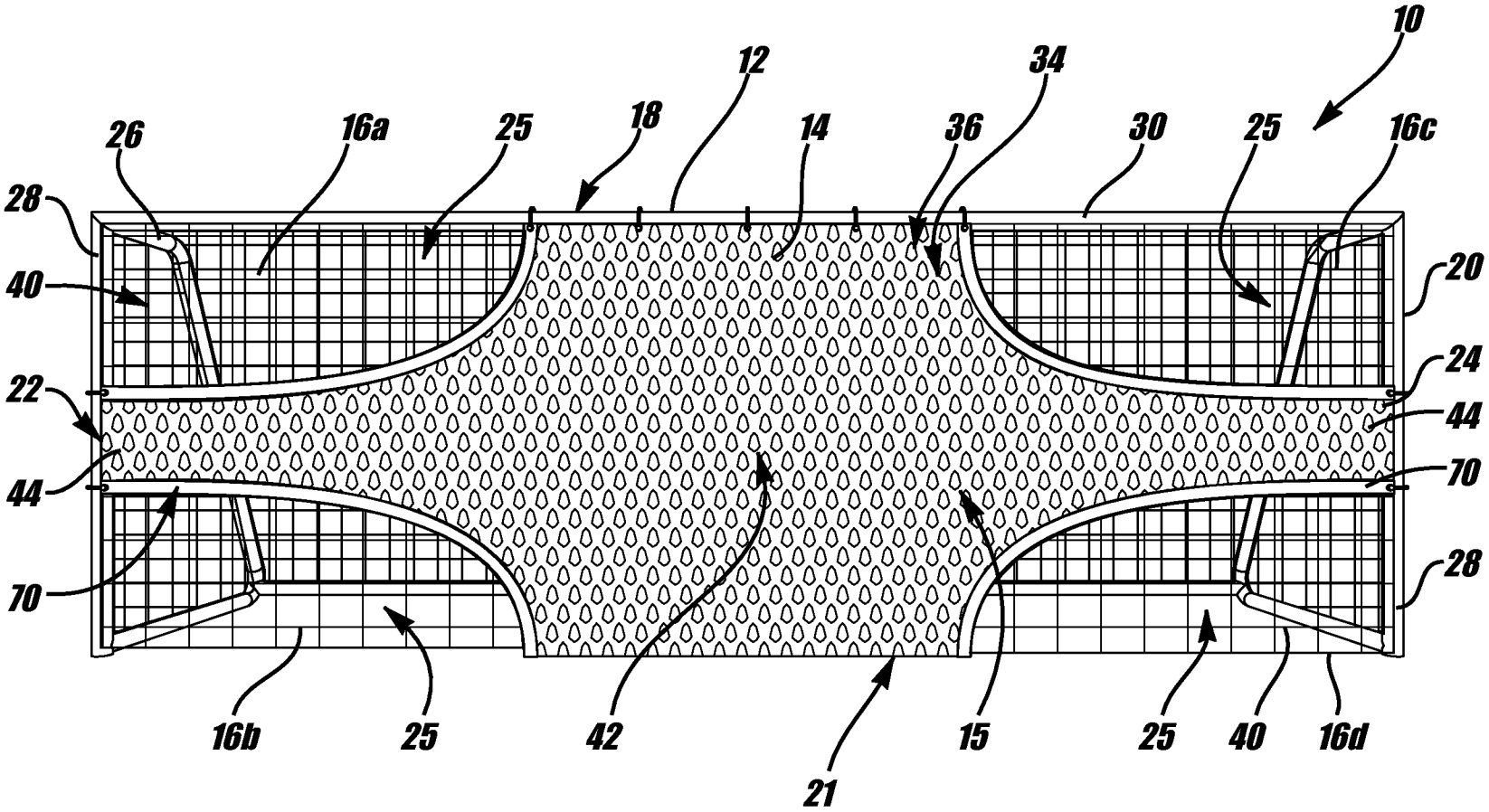
FIG. 3 is a front view of an exemplary embodiment of a hybrid goal shooting training system in accordance with the present disclosure.
Figure 4:
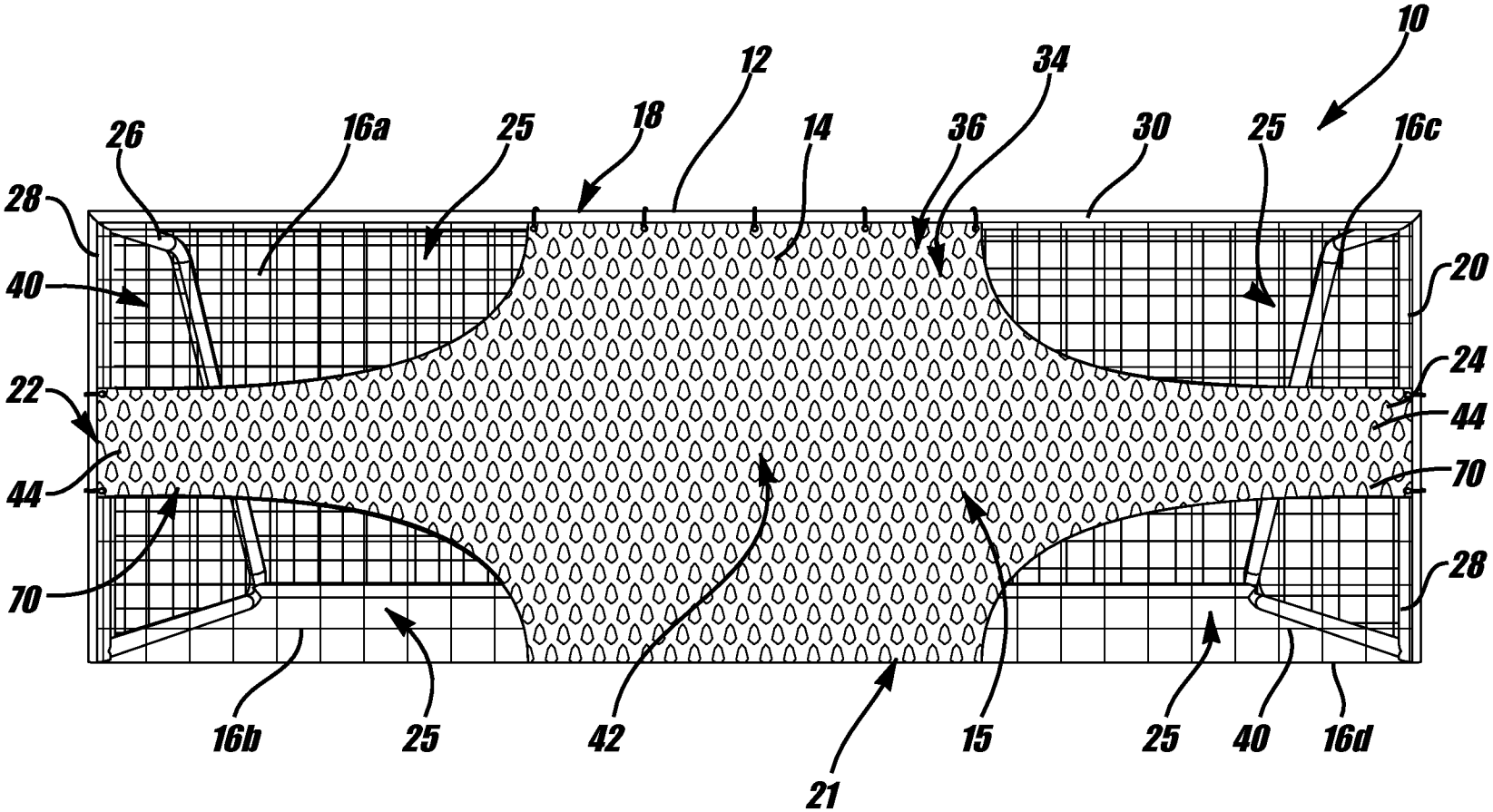
FIG. 4 is a front view of an exemplary embodiment of a hybrid goal shooting training system in accordance with the present disclosure.

Exemplary embodiments of hybrid goal shooting training systems are shown in FIGS. 3 and 4. A hybrid goal shot training system 1 comprises training device 10 including a hybrid training panel 12 configured to be used in combination with a goal frame 26 or goal 20. A typical goal 20 has a frame 26 including two upright posts 28 and a crossbar 30, as well as a net 32 affixed to the goal frame. An end line may form the bottom of the goal.

In exemplary embodiments, the hybrid goal shot training device 10 is connected to crossbar 30. Hybrid training panel 12 may connect to goal shot training device connectors 38, which are installed on crossbar 30. Goal shot training device connectors 38 may comprise hooks and openings, for example. If hooks are used, hybrid training panel 12 may have grommeted openings which may be placed over goal shot training device connector 38 and which correspond positionally to the location of goal shot training device connector 38 on crossbar 30. In an exemplary embodiment goal shot training device connector 38 fits into openings 39 defined in the hybrid training panel 12. Connectors may comprise ropes, cords, strings, hooks, wires, or other fasteners may be inserted into the opening. The ropes, cords, strings, hooks, wires, or other fasteners are also connected to hybrid training panel 12, as would be known to a person of ordinary skill in the art for the purpose of hanging a curtain-like structure. Other connection methods, such as with rope weaving or lashing could also be used.

In exemplary embodiments, the hybrid training panel 12 is of a unitary construction. That is, the cover portion 14 and one or more net portions 16 are integrally formed, and the hybrid training panel 12 is manufactured as a one-piece device. This obviates the need for retailers or end users to make any significant adjustments prior to sale or use of the device. It is possible, however, to initially manufacture the cover portion 14 and net portions 16 as separate components and subsequently connect them by knitting or adhesives, or any other connecting methods. In addition, the end user might be provided the option of attaching different net portions 16 as desired, depending on the type of training.

Referring now to FIGS. 5A-8, it can be seen that exemplary embodiments of hybrid goal shooting training systems may be provided in a variety of different configurations.

Figure 5A:
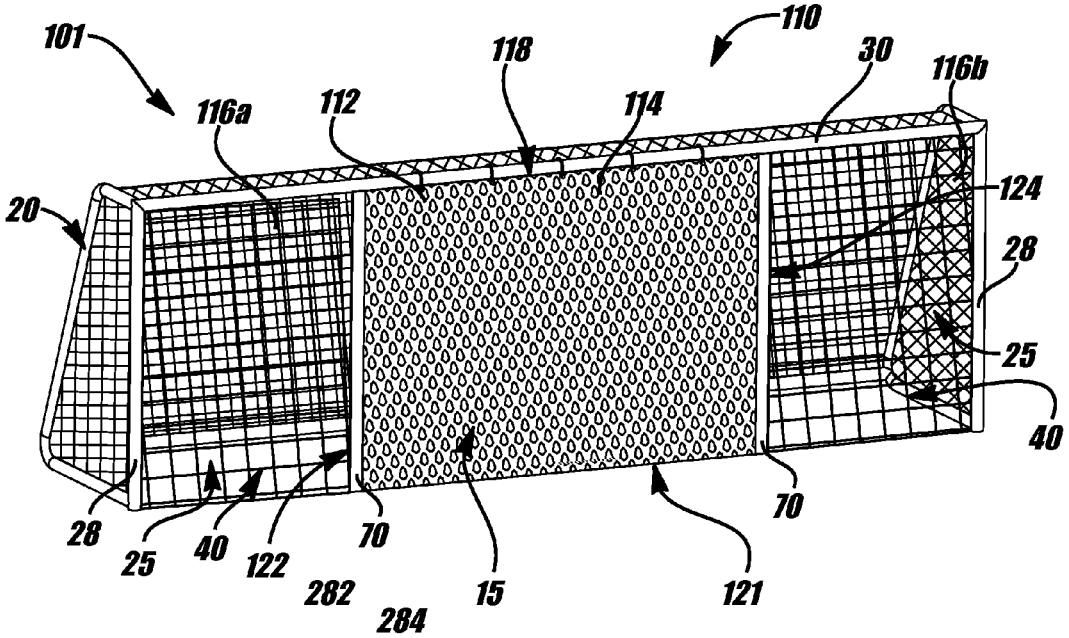
FIG. 5A is a perspective view of an exemplary embodiment of a hybrid goal shooting training system in accordance with the present disclosure.
Figure 5B:
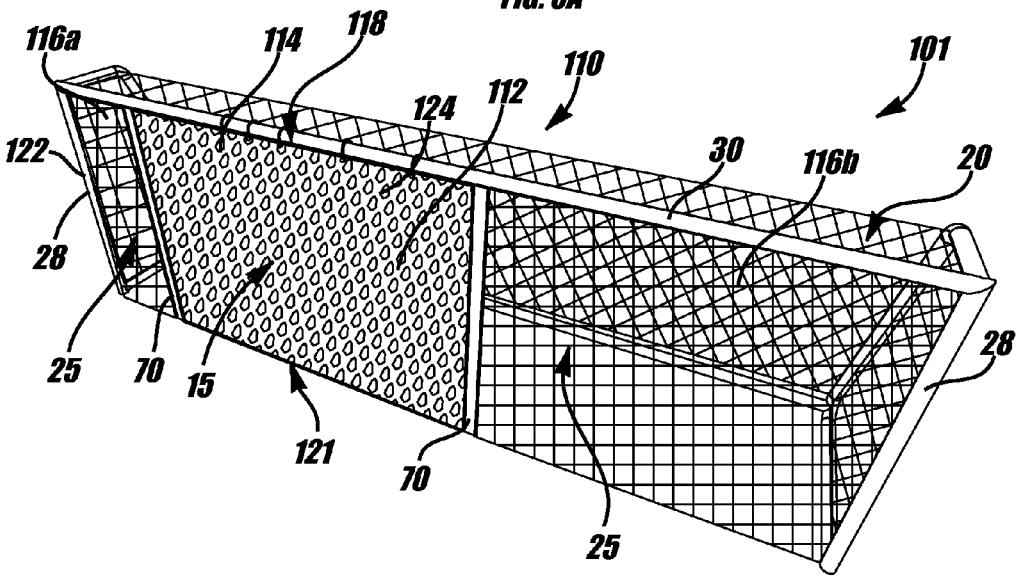
FIG. 5B is a perspective view of an exemplary embodiment of a hybrid goal shot training system in accordance with the present disclosure.
Figure 6:
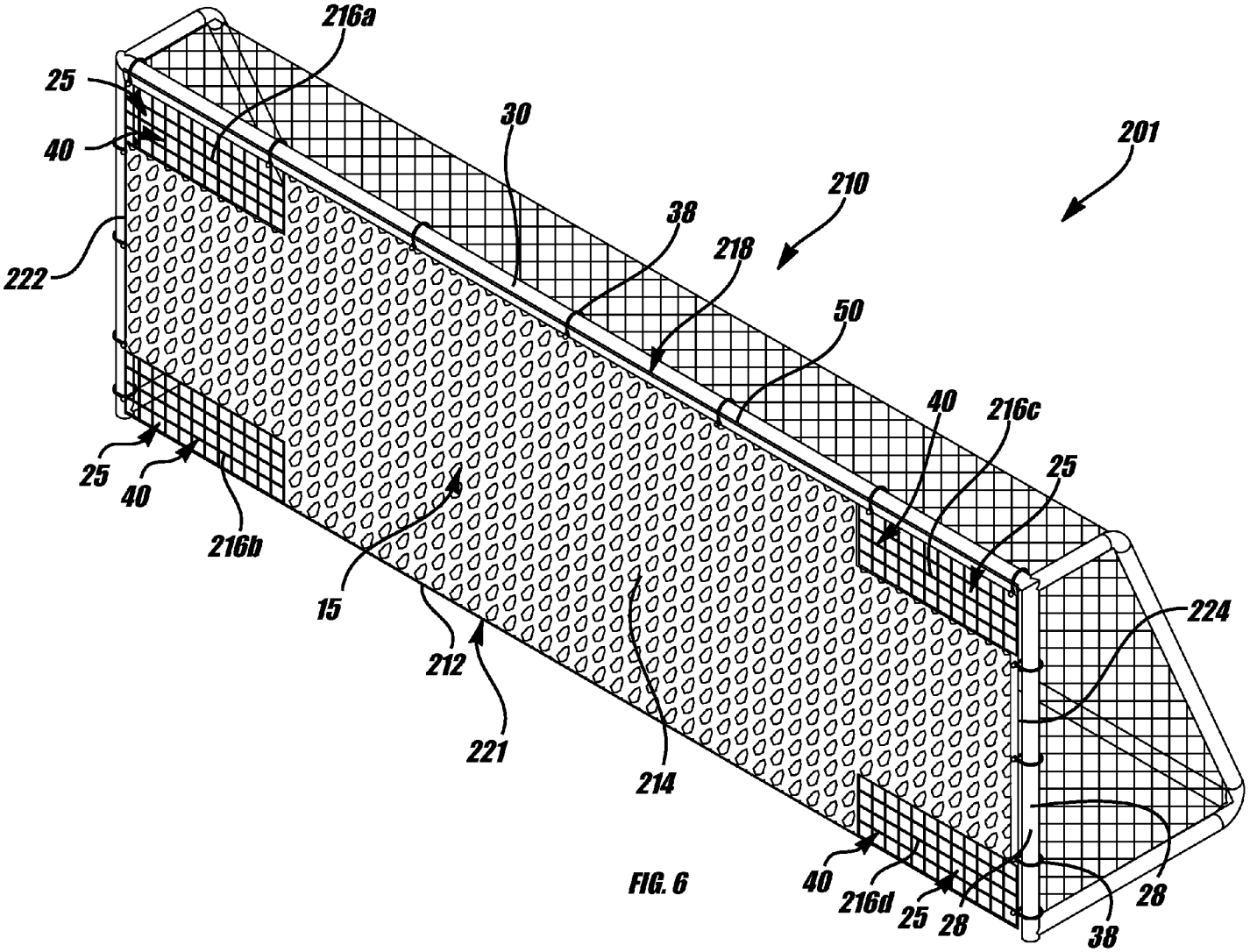
FIG. 6 is a perspective view of an exemplary embodiment of a hybrid goal shooting training system in accordance with the present disclosure.

Embodiments can be tailored to different goal shot training and goals of different sizes, for example. FIGS. 5A and 5B show a hybrid goal shooting training system 101 where the hybrid training panel 112 of the training device 110 has a substantially square or rectangular cover portion 114 having a top edge 118 and a bottom edge 121. The embodiment shown in FIG. 5A has two net portions 116*a*, 116*b* connected to the cover portion 114. First net portion 116*a* is connected to the first side edge 122 of the cover portion 114, and second net portion 116*b* is connected to the second side edge 124 of the cover portion 114. In this embodiment, the two net portions 116*a* and 116*b* create a visual distinction for the player by allowing visual access of positive space 25 behind them in contrast to the cover portion 114 material, which creates negative space 15 by obscuring visual access behind it. As seen in FIG. 5B, exemplary embodiments may have one relatively larger net portion 116 and be positioned at a side of the goal to simulate the goalkeeper's position defending a shot from the left side of the field.

Figure 7:
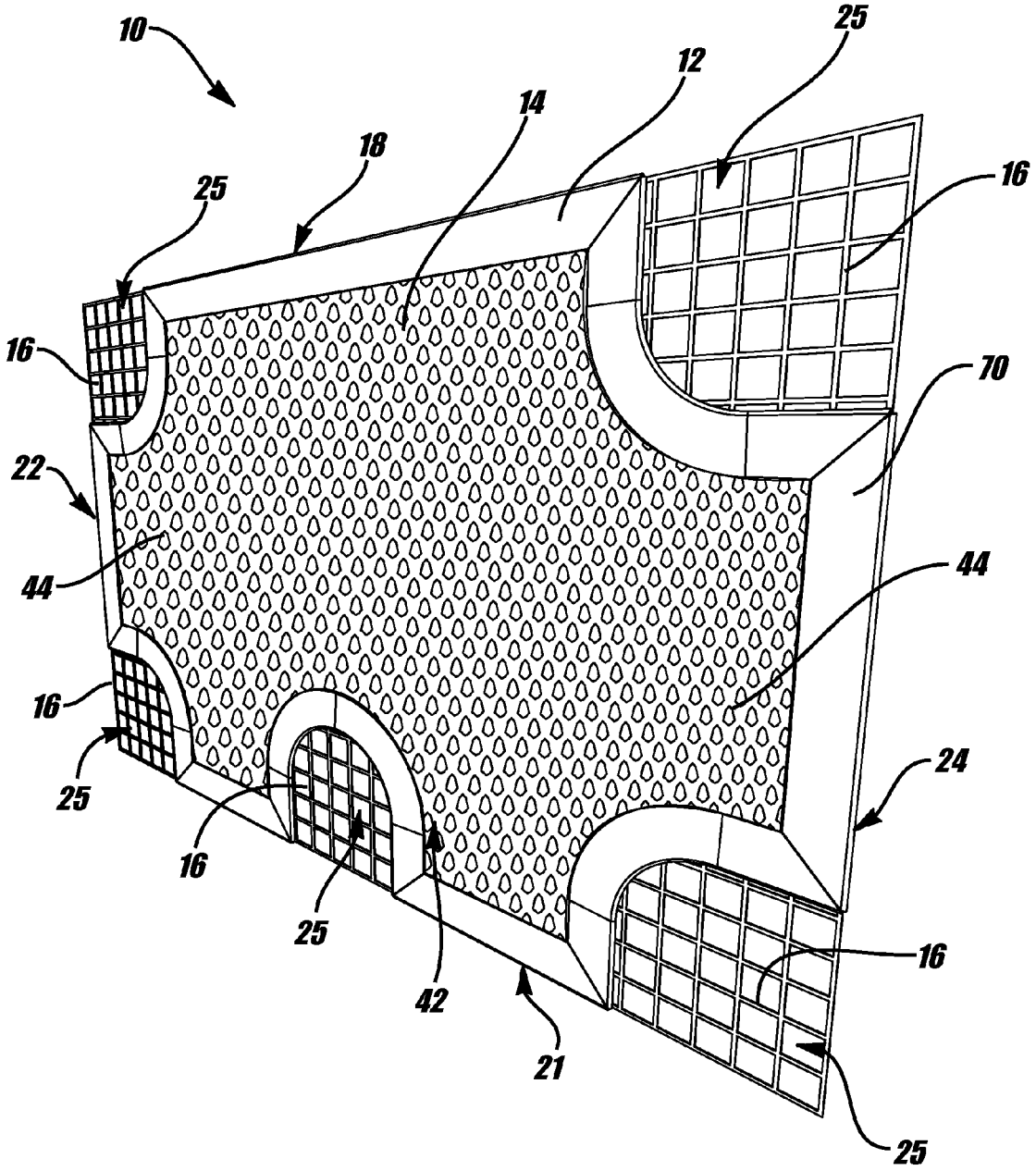
FIG. 7 is a front view of an exemplary embodiment of a hybrid goal shot training device in accordance with the present disclosure.

As discussed above, exemplary embodiments have four net portions 16*a*, 16*b*, 16*c*, and 16*d*, with each net portion connected to the cover portion 14. Referring again to FIGS. 1-4, the net portions 16 could be substantially quarter circle shapes mating with concave edges of a roughly cross-shaped cover portion 14. Another exemplary embodiment of a hybrid training system 201, shown in FIG. 6, could include hybrid training device 210 having a cross-shaped cover portion 214 with top 218, bottom 221, and side edges 222, 224 and four substantially square or rectangular net portions 216*a*, 216*b*, 216*c*, and 216*d* connected to the cover portion. Additional exemplary embodiments of hybrid training devices could have a substantially diamond-shaped cover portion and triangular net portions connected to the cover portion. Other configurations could also be provided, depending on the desired use and the cost of manufacture, including, for example, a hybrid goal shot training device with a substantially oval-shaped cover portion. Exemplary embodiments might have five net portions, as illustrated in FIG. 7, or six or more, to emphasize different numbers and locations of scoring zones represented by positive spaces, which may vary depending on the sport.

Advantageously, embodiments of hybrid goal shooting systems and devices provide a significant visual contrast between the cover portion 14 and the one or more net portions 16. The hybrid training panel 12 comprises both positive viewing spaces 25, i.e., the net portions 16, and negative viewing spaces 15, i.e., the cover portion 14. These spaces are designed to attract the eye or repel the eye, respectively. This is accomplished primarily by the difference in material used for the cover portion 14 and net portions 16 of the hybrid training panel 12.

In exemplary embodiments, the one or more net portions 16 are made of a goal net material 40. For regulation soccer goal nets, the net material typically defines holes that are 4×4 inches with braid or twist nylon or polyester mesh of about 3-5 mm. Other types of net material could be used for smaller soccer goals or other sports such as hockey, field hockey, water polo, and lacrosse. Such net material might have thread or twine size ranging from 1.5 mm to 3.5 mm and hole size ranging from about one half an inch up to about 4 inches. The holes of the net could be any shape, but typically are square- or diamond-shaped.

Figure 8:
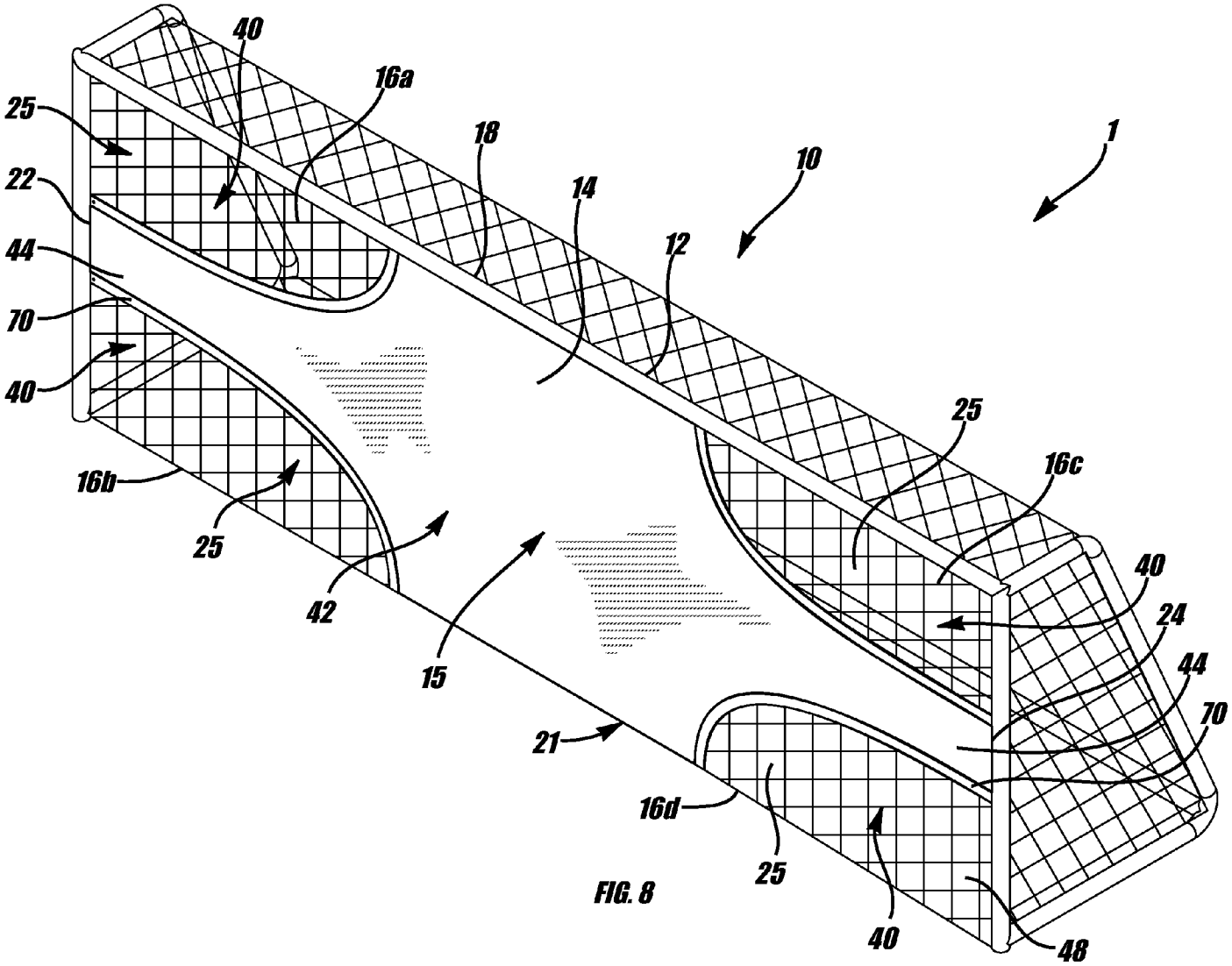
FIG. 8 is a perspective view of an exemplary embodiment of a hybrid goal shooting training system in accordance with the present disclosure.

Referring to FIG. 8, in exemplary embodiments of a hybrid goal shooting training system 1 and device 10, the cover portion 14 of the hybrid panel 12 may be made of a solid material such as cloth, vinyl, polypropylene, polyethylene, and other materials that do not allow light to pass through and are able to withstand the impact of soccer balls, pucks, or other heavy objects without tearing or becoming dislodged. Compared to the relatively large openings and thin threads or mesh of the net material 40, the cover portion 14 material is of a darker color, creating negative viewing space 15. In exemplary embodiments, the cover portion 14 material may be opaque so it appears darker than the net portions 16. When a player looks to the goal after setting up the shot, he or she will be trained to look for positive viewing spaces 25. Consequently, the player will become conditioned to avoid the negative, or relatively dark colored, viewing space 15 altogether in favor of positive, or light colored/open viewing spaces 25 when they look up to goal 20 after setting up a shot in the absence of the hybrid goal shot training device 10.

Returning to FIGS. 1-7, the cover portion 14 may be made of a knit material 34 defining openings 36. The knit material 34 may be a cloth, vinyl, polypropylene, polyethylene, or could be any natural or synthetic textile or combination thereof including, but not limited to, plant-based textiles such as grass, rush, hemp, or sisal, mineral-based textiles such as asbestos, basalt fibre, glass fibre, metal fibre, metal foil, or metal wire, and/or synthetic textiles such as polyester fibre, aramid fibre, acrylic, nylon, spandex, olefin fibre, ingeo, lurex, or carbon fibre or any other material that can be knit into a covering defining openings and is able to withstand the impact of soccer balls without tearing or becoming dislodged. In exemplary embodiments, the knit material 34 is substantially opaque to effectively create negative viewing space 15 that obscures visual access behind the net portion 14 of the hybrid training panel 12.

Figure 9:
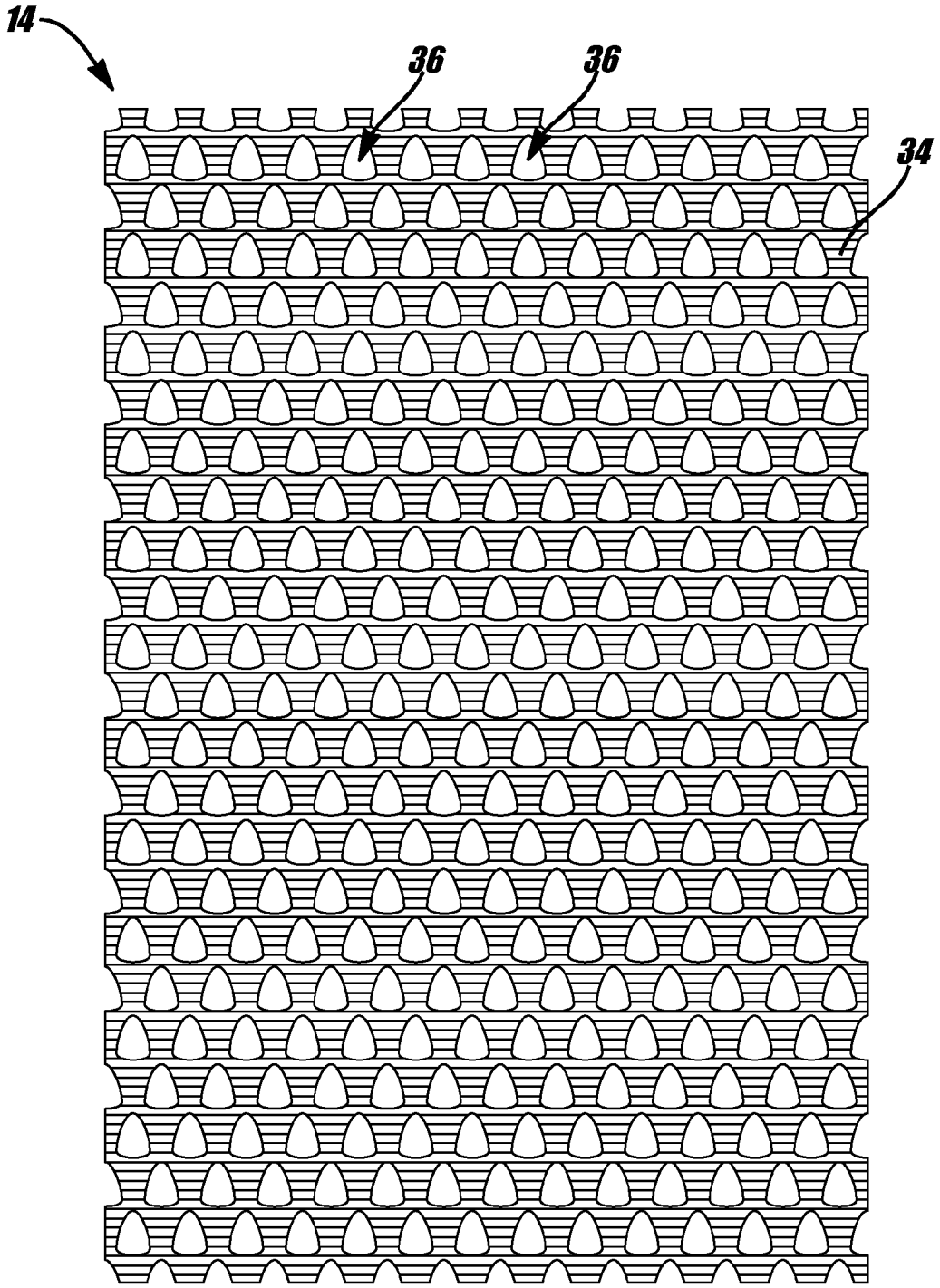
FIG. 9 is a detail view of an exemplary embodiment of a training panel knit material in accordance with the present disclosure.

As best seen in FIG. 9, the knit material 34 of the cover portion 14 of the hybrid training panel 12 defines multiple openings 36. The openings 36 are sized and shaped so they do not blend in with the typically square- or diamond-shaped holes of the net portions 16 of hybrid training panel 12. More particularly, exemplary openings 36 are not square-shaped so they can be easily visually differentiated from the holes in most goal net material 40. In exemplary embodiments, the openings 36 in the knit material 34 are substantially egg-shaped or teardrop-shaped, but the openings may be any desired shape so long as the shape differs enough from that of the holes of the net portion 16 material being used to provide a visual distinction between the cover portion 14 and the net portions 16.

The openings 36 in the knit material 34 may also vary in size and can be any size so long as they allow air to pass through while maintaining a sufficient visual distinction between the cover portion 14 and the net portions 16 of the hybrid training panel 12. In exemplary embodiments, the openings 36 are up to about ¼ inch in length or height and up to about ⅛ inch wide, dimensions significantly smaller than, e.g., soccer goal nets, which typically have holes that are 4×4 inches. However, the openings 36 in the knit material 34 could be larger, up to about 3.8 inches by 3.8 inches, so long as they are smaller than the openings of the net portion 16 such that they create visual distinction between the cover portion 14 and the net portions 16 of the hybrid training panel 12.

The knit material 34 and openings 36 therein provide a number of advantages. For instance, the openings 36 allow air to pass through so the goal shot training device 10 maintains its original position when used outdoors in windy conditions. With the multiple openings 36 facilitating passage of the wind, the hybrid training panel 12 remains relatively still instead of flapping and moving around in the wind. The knit material 34 is also strong and heavy enough to add rigidity, thereby enhancing the ability of the hybrid training panel 12 to maintain its original position in inclement weather. Moreover, due to the openings 36, the knit material 34 creates a substantial degree of visual distinction with less material, thereby reducing manufacturing costs.

Perhaps most importantly, the openings 36 are small enough such that there is enough surrounding knit material 34 to provide substantial cover area to obscure most of the goal 20 and create a visual distinction or contrast with the net portions 16 of the hybrid goal shot training device 10, i.e., to create negative viewing space. More particularly, the hybrid training panel 12 creates both positive viewing spaces 25 and negative viewing spaces 15. These spaces are designed to attract the eye or repel the eye, respectively. In exemplary embodiments, the effect of the knit material 34 and openings 36 is to make the cover portion 14 translucent. One important metric for determining the optimal size of the openings 36 to create positive 25 and negative viewing spaces 15 is the percentage of light transmitted through the net portion 14 of the hybrid training panel 12. The percentage of light transmission should create a visual distinction between the cover portion 14 and the net portions 16 and could range from about 5% to about 90%, with exemplary embodiments having a light transmission percentage between about 25% and 75%.

To further enhance the visual distinction between the cover portion 14 and the one or more net portions 16 of the hybrid goal shot training device 10, a band 70 of material may be provided at or near the boundaries between the cover portion 14 and the one or more net portions 16 where the net portions 16 connect to the cover portion 14. As best seen in FIGS. 1 and 3, exemplary embodiments comprise a band 70 of material running along one or more side edges 22, 24 of the cover portion 14 of the hybrid training panel 12 and/or between side edges 22, 24 and top and bottom edges 18, 21.

An exemplary band 70 is made of material having a color that creates a significant visual distinction with the relatively dark color of the solid material or knit material 34 of the cover portion 14. For instance, the band 70 of material may be brightly colored in green, yellow, orange or other colors. The band 70 may run along the side edges 22, 24 of the cover portion 14 of the hybrid training panel 12, and/or may run between side edges 22, 24 and top and bottom edges 18, 21 where the net portions 16 meet the cover portion 14. Alternatively, the band 70 may run along the edges of the net portions 16 at or close to where the net portions 16 meet the cover portion 14. Multiple arrangements and layouts of the colored band 70 are possible so long as the band creates a significant visual distinction with the relatively dark color of the solid or knit material 34 of the cover portion. This distinction created by the band 70 advantageously attracts the visual attention of the practicing player and enhances the training of the player. More particularly, the player sees the brightly colored band 70 and is thus more likely to shoot the ball, puck or other object to the positive viewing spaces 25 of the net portions 16.

As mentioned above, hybrid goal shot training device 10 is provided to condition players to shoot towards the most effective areas in goal 20. In exemplary embodiments, positive viewing spaces 25 comprise the net portions 16 of the hybrid training panel 12. These positive viewing spaces 25 allow the player of soccer, hockey, polo, lacrosse, or other sports to quickly locate an unobstructed target to aim for. That is, when a player looks to goal 20 after setting up the shot, positive viewing spaces 25 are the goal areas in which the player can see net material 40. By training themselves to look for openings in hybrid training panel 12, players become conditioned to look first for the high probability scoring areas of the goal after setting up the shot, which increases the likelihood of shooting the balls to those areas. Although negative viewing space 15 is generally intended to be covered, positive viewing spaces 25 may either be covered with a pattern or color, such as a light color, that causes the player to look first at the positive viewing space or be plain net material 40 of the net portions 16 in hybrid training panel 12 at which a soccer ball may travel to simulate actually kicking a scoring shot.

Figure 19:
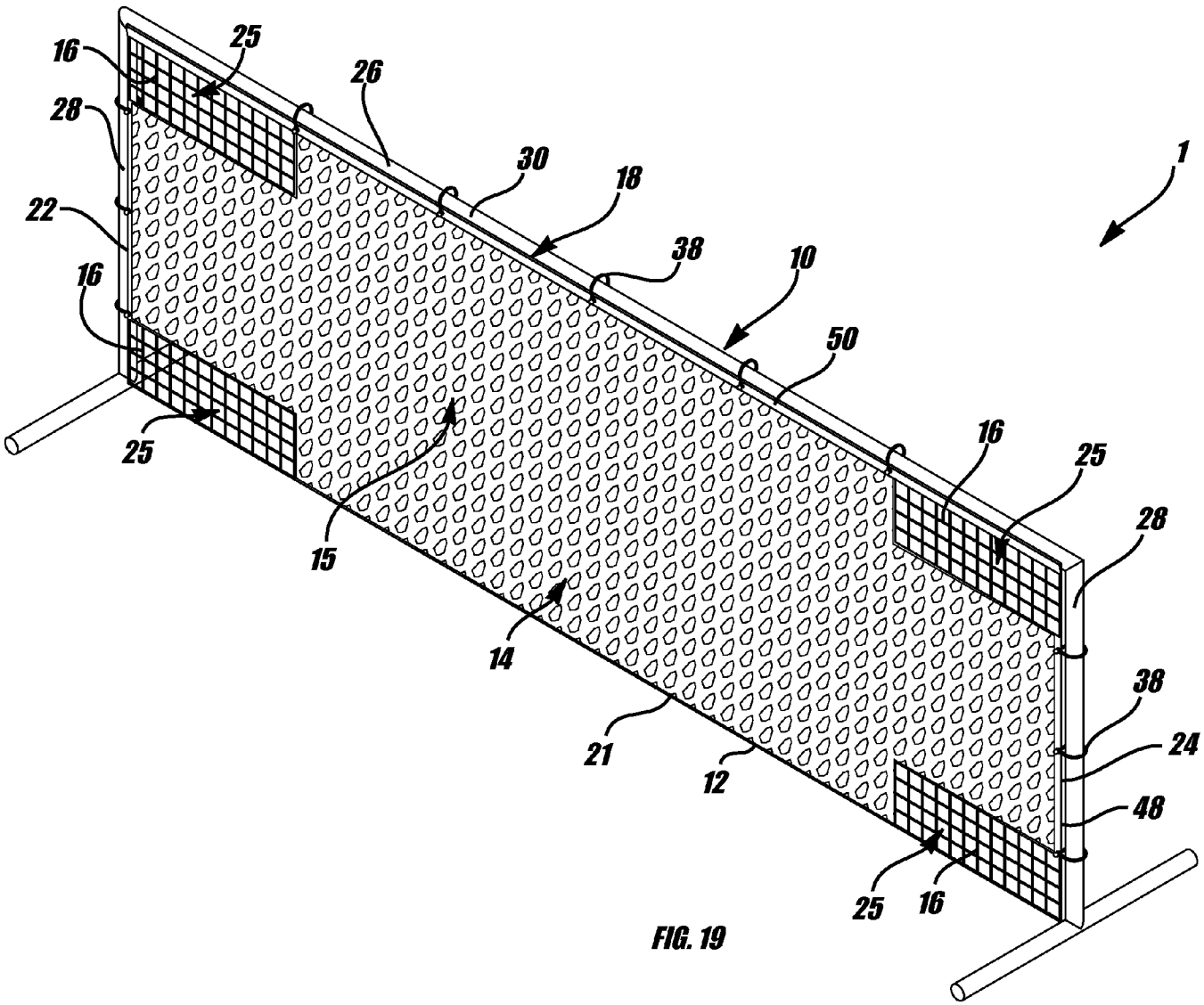
FIG. 19 is a perspective view of an exemplary embodiment of a hybrid goal shooting training system in accordance with the present disclosure.

As shown in FIG. 19, a hybrid goal shot training device 10 may be used as part of a system 1 wherein the hybrid training panel 12 is connected to a goal frame 26 for a substantially flat goal. More particularly, the hybrid training panel 12 could be connected to the frame 26 in place of the net that would ordinarily be connected to the frame 26 of a flat goal. Whether used with a typical goal or the frame of a flat goal, the top edge 18 of the cover portion 14 of the covering 12 may be connected to the crossbar 30. The side edges 22, 24 of the cover portion 14 of the hybrid panel 12 may be connected to the upright posts 28. Net portions 16 could also be connected to the goal frame to provide better stability.

Figure 20:
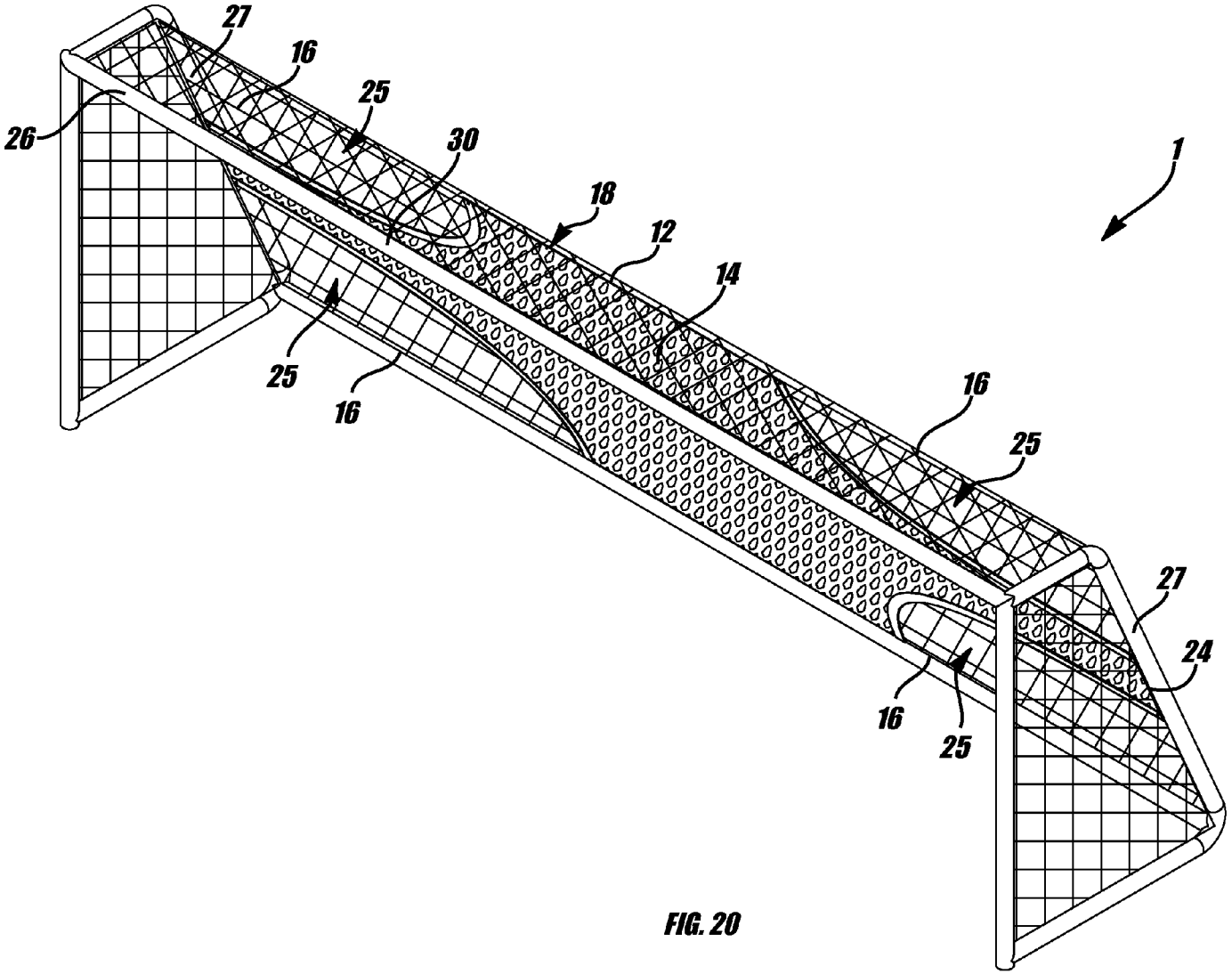
FIG. 20 is a perspective view of an exemplary embodiment of a hybrid goal shooting training system in accordance with the present disclosure.

Turning to FIG. 20, exemplary embodiments of a hybrid goal shooting training system 1 and goal shot training device 10 could be provided such that the hybrid training panel 12 is connected the rear portions of a goal frame 26. More particularly, the hybrid training panel 12 could be connected to a goal frame 26 in place of the net that would ordinarily form the back of a conventional goal 20. The side edges 22, 24 of the cover portion 14 of the hybrid panel may be connected to rear posts 27 of the goal frame 26. In this way, the player would train the same way as described herein, but would focus on the hybrid goal shot training device 10 located deeper or further back in the goal 20 instead at the front.

In operation, goal shot training device 10 may be placed very close to the imaginary plane the ball, puck or other object must cross to score a goal so that use of goal shot training device 10 conditions a player to aim at areas of the goal where a scoring shot is the likeliest. In exemplary embodiments, positive viewing spaces 25 comprise light, or bright colored areas of hybrid training panel 12. After setting up the shot, therefore, players will be instructed to look for the light or bright spaces and shoot for those areas. Consequently, the players will become conditioned to shoot to the light or bright colored areas of goal shot training device 10, even when the goal shot training device 10 is not in place.

In exemplary embodiments, negative viewing spaces 15 of hybrid goal shot training device 10 are designed to be deemphasized when a player looks to goal 20 after setting up a shot. De-emphasis of negative viewing spaces 15 conditions players to first see positive viewing spaces 25 by instinct. Thus, the player will be less likely to shoot at negative viewing spaces 15 and more inclined to initially see positive viewing spaces 25 and shoot to those areas. In exemplary embodiments, negative viewing spaces 15 are darker colored spaces relative to the positive viewing spaces 25. When players look to the goal after setting up the shot, they will be trained to look for positive viewing spaces 25. Consequently, the player will become conditioned to avoid the negative, or dark colored, viewing spaces 15 altogether in favor of positive, or light colored/open viewing spaces 25 when they look up to goal 20 after setting up a shot in the absence of hybrid goal shot training device 10.

Moreover, in exemplary embodiments, negative viewing spaces 15, in the form of the cover portion 14 of the hybrid training panel 12, may be shaped to imitate the range of a goalkeeper. For example, negative viewing spaces 15 may be roughly cross-shaped to imitate the range over which a goalkeeper is likely to make a save. For example, the cover portion 14 of the hybrid training panel 12 may have a central area 42 that roughly imitates the range of a goal keeper's body, and side extensions 44 that roughly imitate the range of a goal keeper's arms. Thus, players who train with hybrid goal shot training device 10 will become conditioned to shoot to areas where the goalkeeper is less likely to stop shots, improving their chances for scoring a goal by aiming the ball, puck or other object to areas of the goal that have a higher likelihood of successfully passing through the goal.

According to exemplary embodiments, hybrid goal shot training device 10 may have different configurations and may be positioned differently depending on the angle of the shot. When a shooter moves to the right of the field and goal, for example, the goalkeeper typically shifts slightly to the shooter's right. The keeper's shift reflects the greater difficulty in shooting a ball to the far post 28*a* versus shooting the ball to the near post 28*b*. By shifting positions, the goalkeeper reduces likelihood of a scoring shot by covering the areas comprising the easiest shots for the shooter over the entire area of goal 20.

To reflect the changed likelihood for scoring shots induced by the goalkeeper's shift in position, goal shot training device 110 may be modified, e.g., by repositioning, to reflect the changed shot success likelihood circumstances induced by the goalkeeper's change in position, according to embodiments. As discussed above, with reference to FIGS. 5A and 5B, an exemplary hybrid goal shooting training system 101 and device 110 may have a hybrid training panel 112 with a substantially square or rectangular cover portion 114 and two net portions 116*a*, 116*b* connected to the cover portion 114. When the shooting team moves the ball, puck, or other object to the left side of the playing area, the goalkeeper moves to the left as well, creating a larger space in the right part of goal 20 that cannot be covered by the keeper. Thus, hybrid goal shot training device 10 may be configured so that the negative viewing space 15 of the cover portion 114 would be smaller in the left of the goal, while creating a larger positive space 25, by having a larger net portion 116*b* in the right part of the goal where the goalkeeper cannot easily protect than the relatively smaller net portion 116*a* in the left part of the goal, as shown in FIG. 5B.

The change in positive viewing spaces 25 reflecting the variations in likelihood of successful shots at the goal, measured as a function of where the ball is shot with respect to areas of the goal, may be accomplished by shifting the hybrid training panel 12. Shifting hybrid training panel 12 moves negative viewing space 15 to the right from the shooter's perspective, creating additional positive viewing space 25 in the left part of the goal. Thus, additional positive viewing spaces 25 may be accomplished by shifting hybrid training panel 12.

Figure 10:
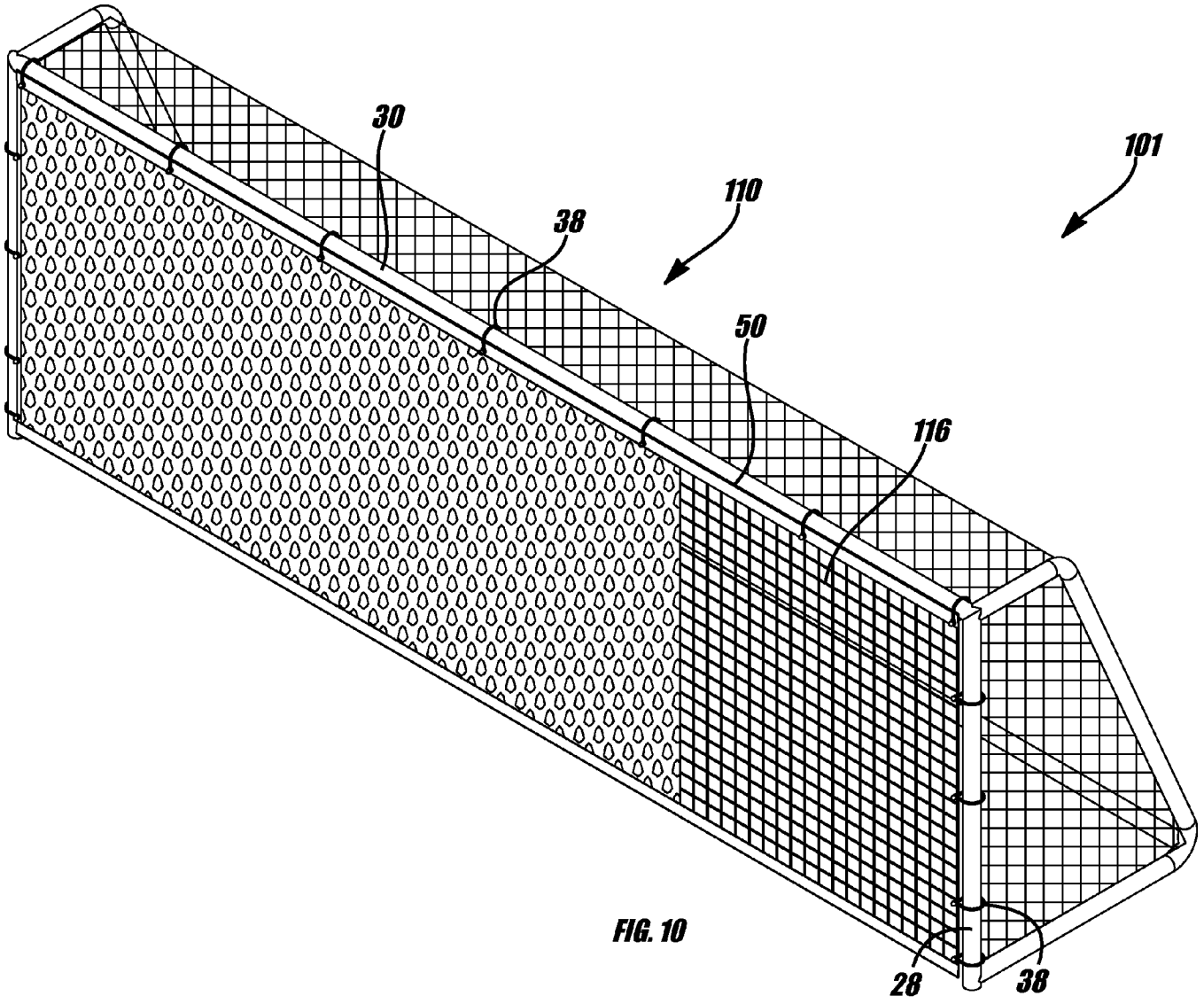
FIG. 10 is a perspective view of an exemplary embodiment of a hybrid goal shooting training system in accordance with the present disclosure.
Figure 11:
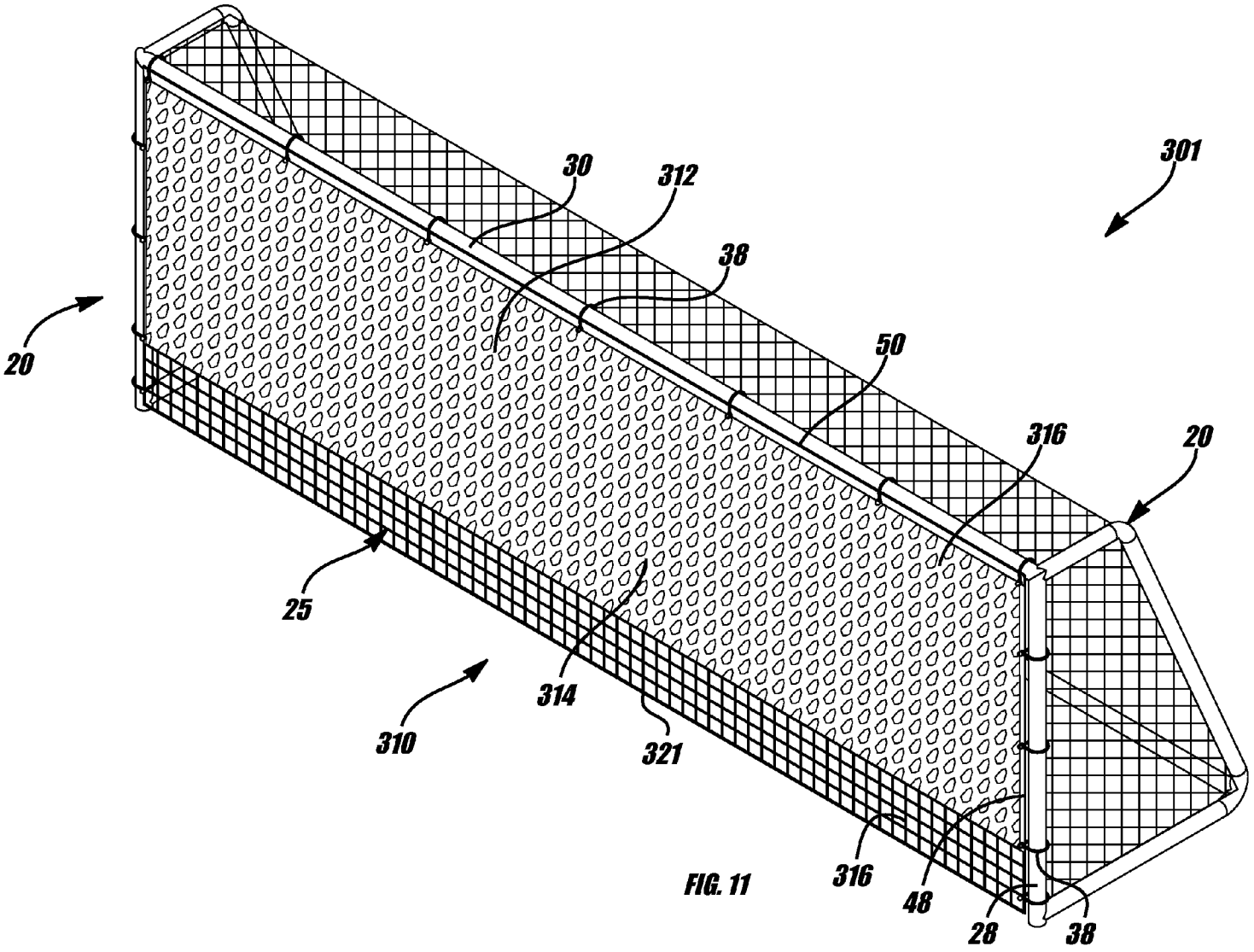
FIG. 11 is a perspective view of an exemplary embodiment of a hybrid goal shooting training system in accordance with the present disclosure.
Figure 12:
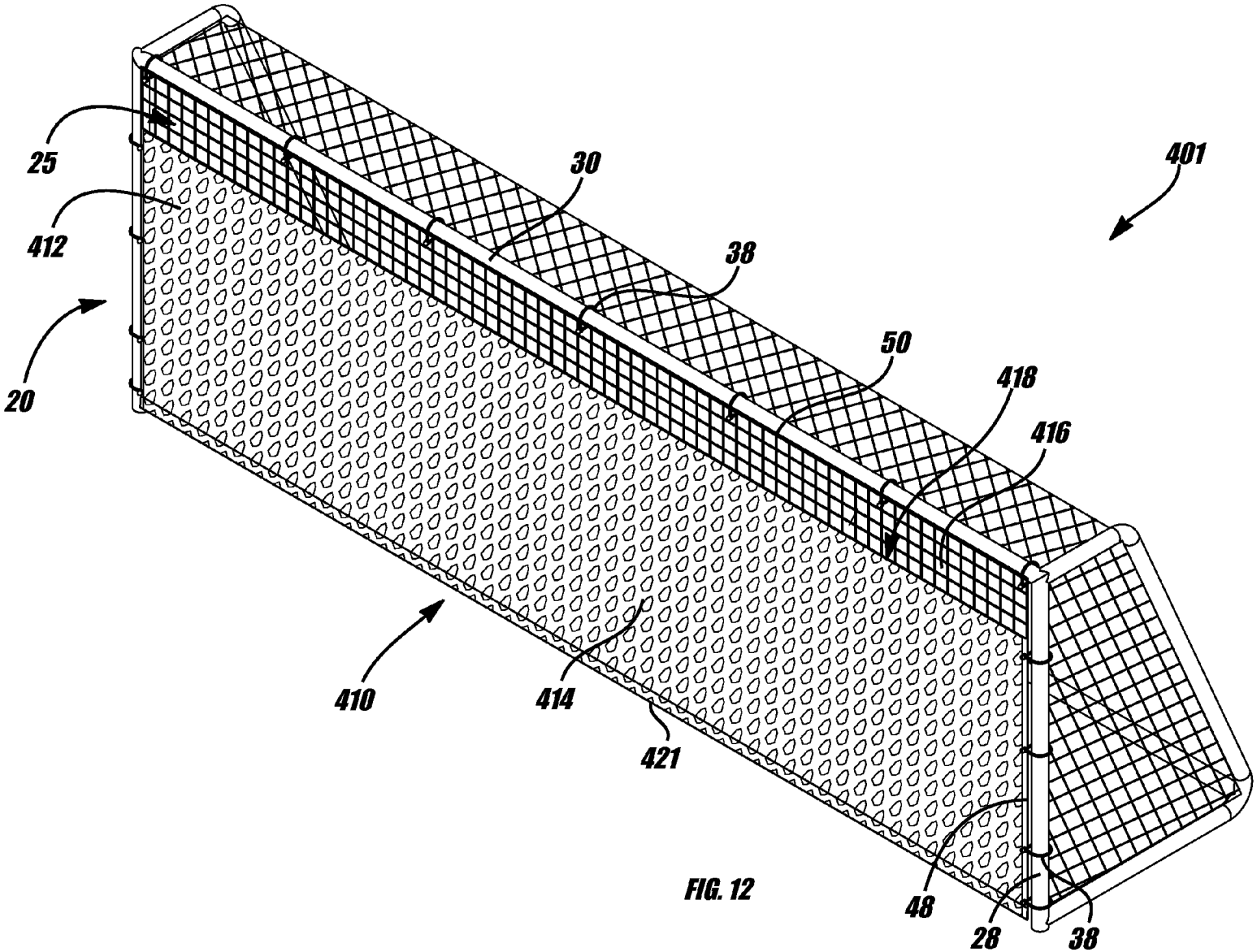
FIG. 12 is a perspective view of an exemplary embodiment of a hybrid goal shooting training system in accordance with the present disclosure.

As best seen in FIG. 10, exemplary embodiments could also eliminate the right or left positive viewing spaces altogether and have one net portion on either the right or left side of the cover portion with the opposite side of the cover portion being flush against an upright post of a goal. Thus, players may be conditioned to shoot at the far post of the goal by configuring hybrid goal shot training device 110 to completely obscure one side of the goal thereby forcing the player to shoot at the opposite side. According to similar embodiments, hybrid goal shot training device 110 may be deployed asymmetrically across the goal depending on the specific training goals sought, as will be known and understood by artisans.

As shown in FIGS. 11-14, exemplary embodiments may be used to condition players to shoot specific types of shots. For example, the training panel 312 of a hybrid goal shot training system 301 and device 310 illustrated in FIG. 11 may have a net portion 316 attached to the bottom edge 321 of the cover portion 314 such that there are positive viewing spaces 25 only close to the ground. Using this embodiment, players with difficulty shooting low shots may train and condition themselves to shoot shots at goal 20 close to the ground. Similarly, an exemplary embodiment shown in FIG. 12 could provide a panel 412 of a hybrid goal shot training system 401 and device 410 with a net portion 416 attached to the top edge 418 of the cover portion 414 such that there are positive viewing spaces 25 only close to the top edge 418 of the goal 20. Using this embodiment, players with difficulty shooting high shots may train and condition themselves to shoot shots at goal 20 close to the crossbar 30.

Figure 13:
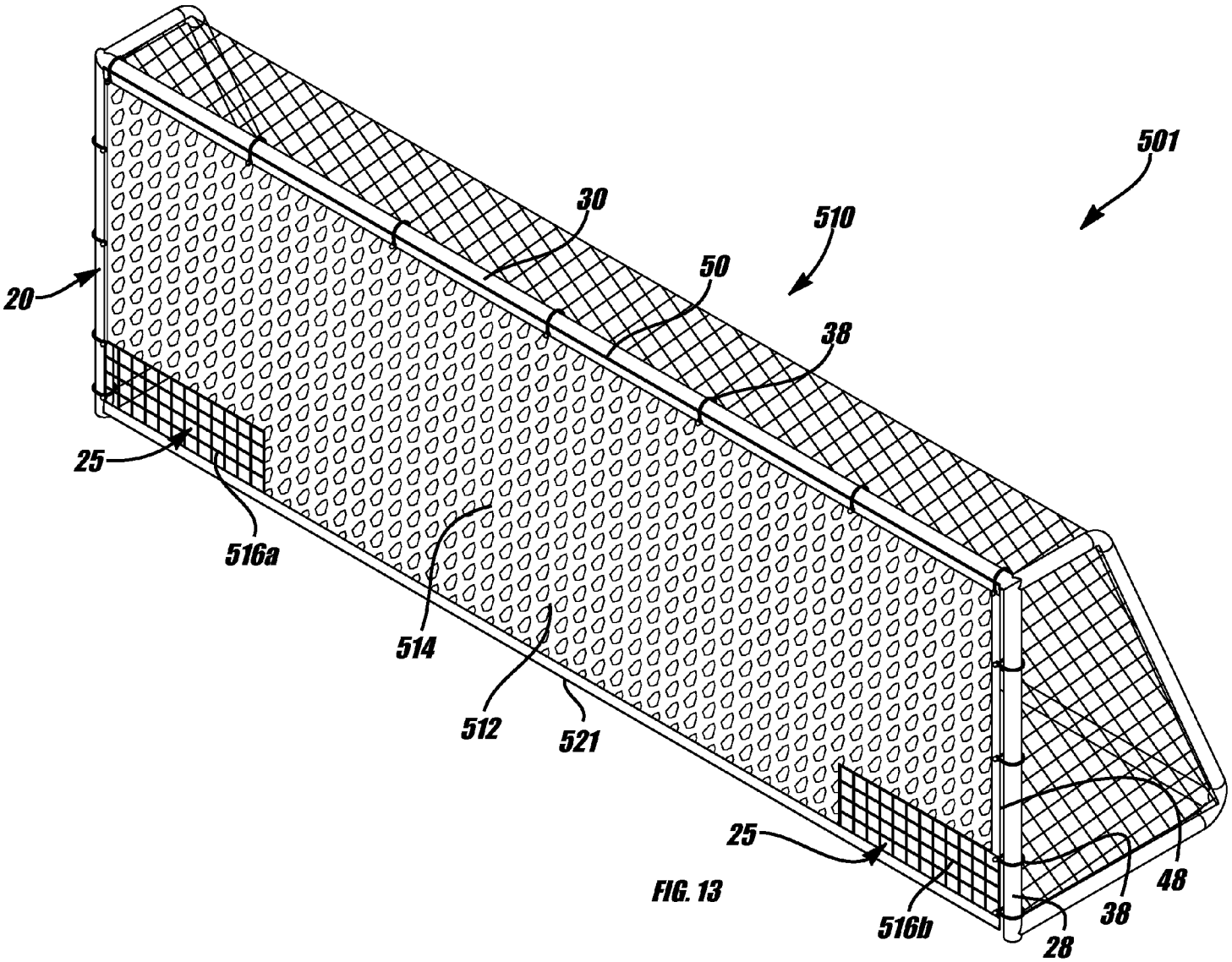
FIG. 13 is a perspective view of an exemplary embodiment of a hybrid goal shooting training system in accordance with the present disclosure.
Figure 14:
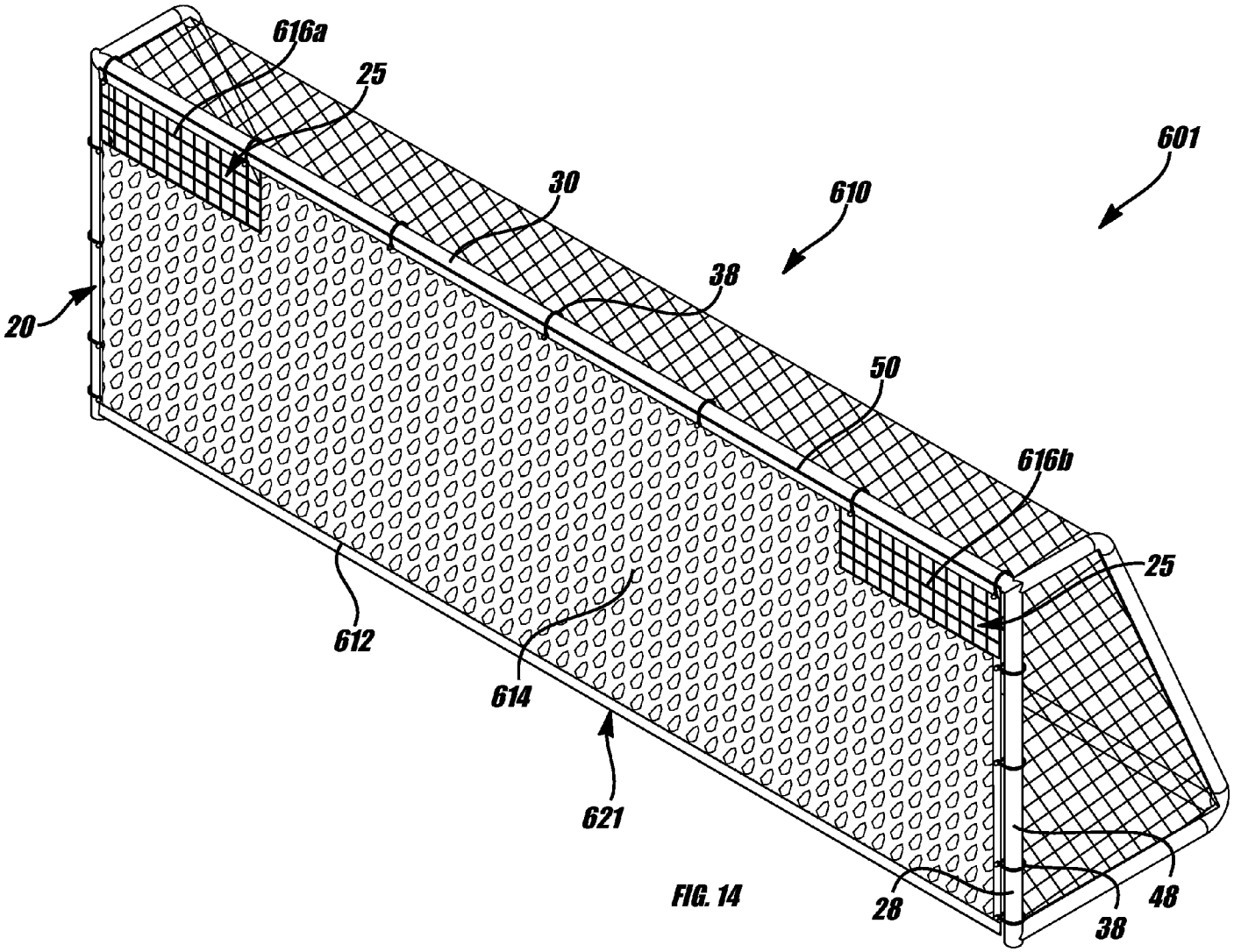
FIG. 14 is a perspective view of an exemplary embodiment of a hybrid goal shooting training system in accordance with the present disclosure.

An exemplary embodiment of a hybrid goal shot training system 501 and device 510 shown in FIG. 13 may have a training panel 512 with two lower corner net portions 516, with net portion 516*a* connected to the cover portion 514 at a bottom left edge and net portion 516*b* connected to the cover portion 514 at a bottom right edge such that there are positive viewing spaces 25 only at the lower corner areas of the goal 20. Using this embodiment, players with difficulty shooting lower corner shots may train and condition themselves to shoot such shots. FIG. 14 illustrates an exemplary embodiment of a hybrid goal shot training system 601 and device 610 where the training panel 612 has two upper corner net portions 616, with net portion 616*a* connected to the cover portion 614 at a top left edge and net portion 616*b* connected to the cover portion 614 at a top right edge such that there are positive viewing spaces 25 only at the upper corner areas of the goal 20.

Figure 15A:
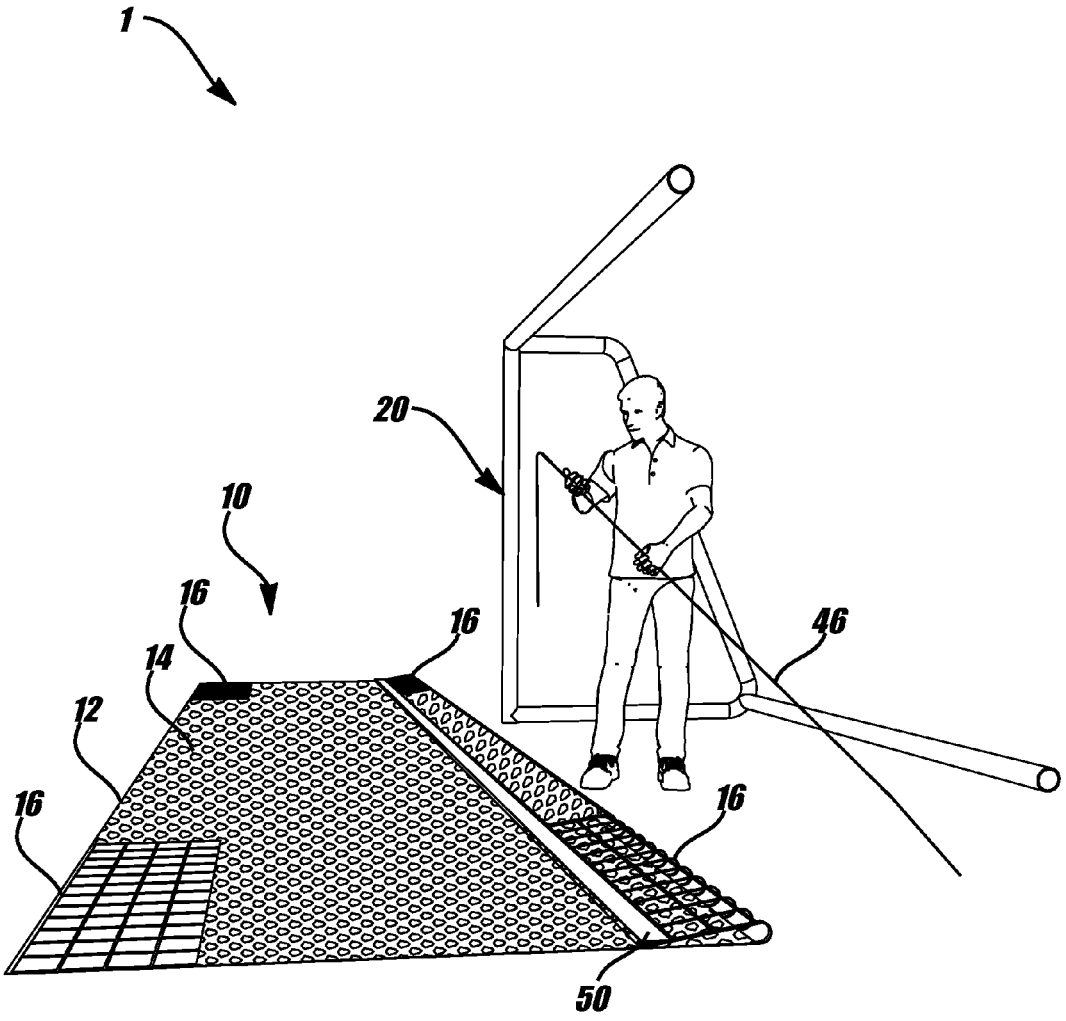
FIG. 15A is a perspective view of an exemplary embodiment of an attachment mechanism and method in accordance with the present disclosure.
Figure 15B:
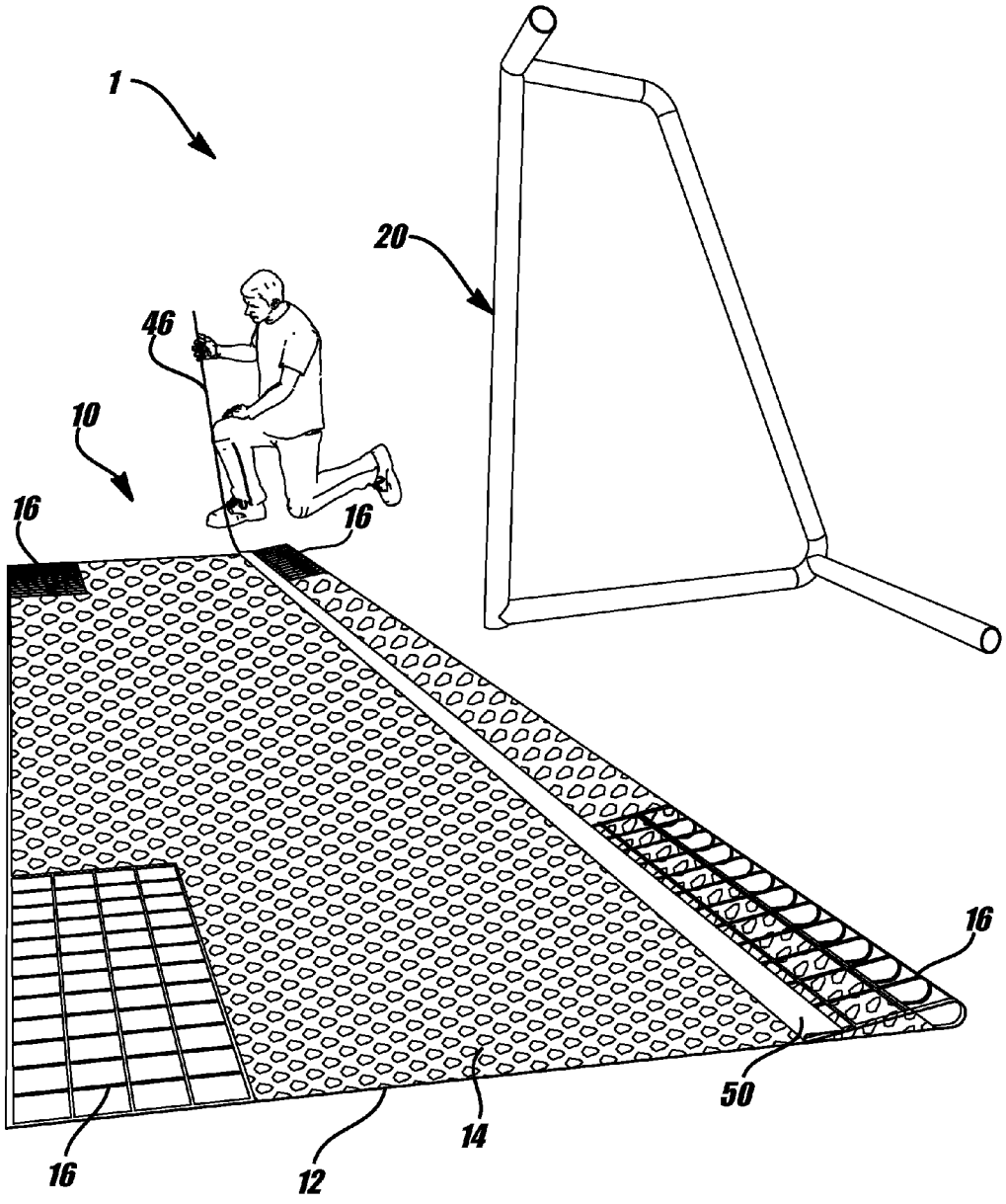
FIG. 15B is a perspective view of an exemplary embodiment of an attachment mechanism and method in accordance with the present disclosure.
Figure 16:
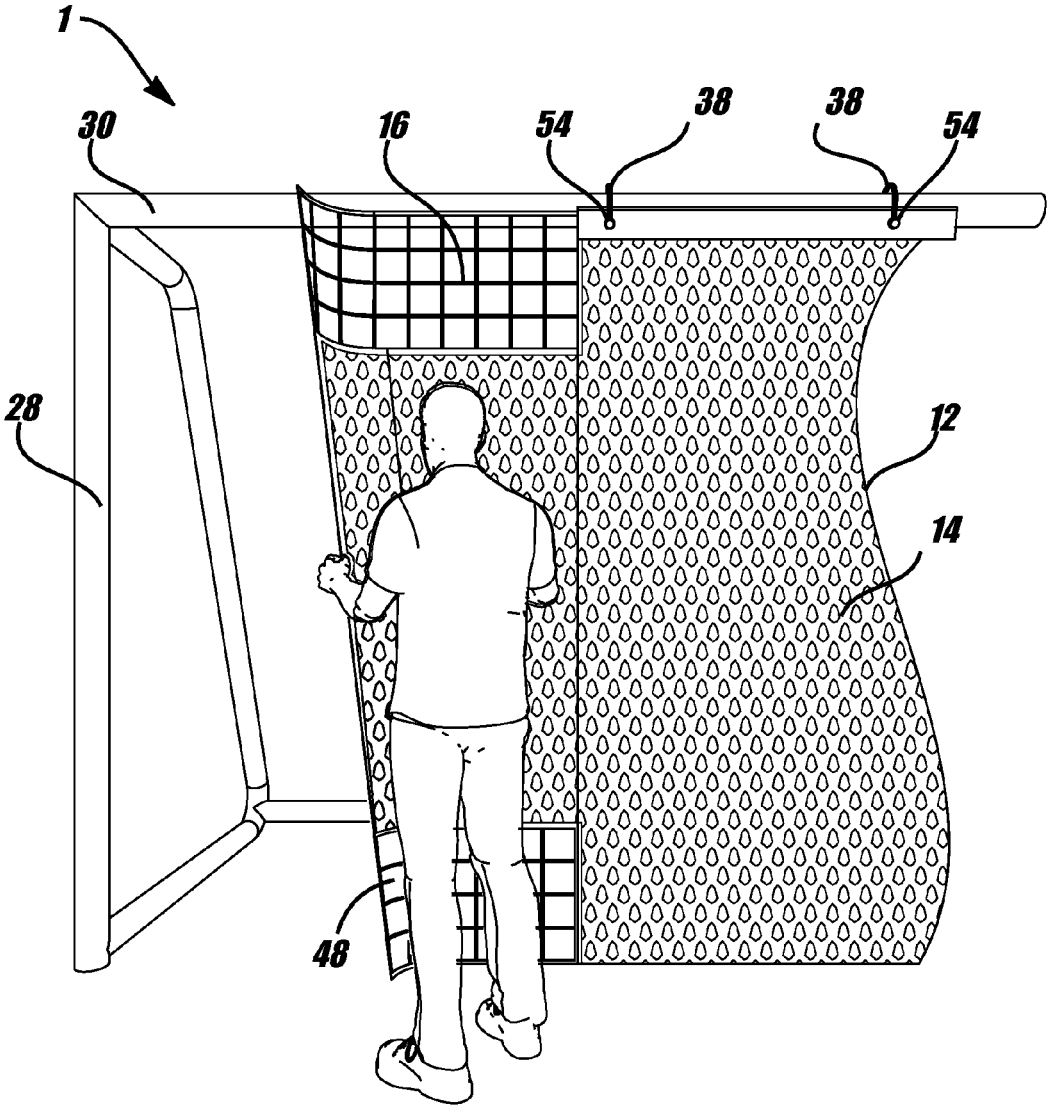
FIG. 16 is a perspective view of an exemplary embodiment of an attachment mechanism and method in accordance with the present disclosure.

In exemplary embodiments, assembly of hybrid goal shot training device 10 may be accomplished by inserting one or more supporting members and affixing to posts 28 and crossbar 30 of goal 20 with straps. As shown in FIGS. 15A-B and 16, installation of hybrid goal shot training device 10 may be accomplished by placing one or more support members 46, 48 into receivers 50 disposed in hybrid training panel 12. Support members 46, 48 may include devices, such as poles, that provide increased rigid structure to the hybrid goal shot training device 10. For example, collapsible fiberglass poles that are often used as tent poles may be used as support members 46, 48. Support members 46, 48 may be disposed at the top, bottom, or along the vertical sides of the cover portion 14 of hybrid training panel 12. Receivers 50 may define pockets configured to receive support members 46, 48. In exemplary embodiments, receivers 50 are disposed across the top and bottom of goal cover hybrid training panel 12. According to similar embodiments, receivers 50 may be disposed across the top, bottom, and along the vertical sides of hybrid training panel 12.

After support members 46 are disposed into receivers 50 along the portion of hybrid training panel 12 that is to be connected to crossbar 30*f*, hybrid training panel 12 is connected to goal 20. One or more connector straps 38 connect hybrid training panel 12 to goal 20. To connect connector straps 38 to hybrid training panel 12, one or more connection openings 54 are disposed along receivers 50, which exposes support member 46. Each strap 52 is threaded between support member 46 and hybrid training panel 12 at at least one connection opening 54. Thereafter, strap 52 is placed around crossbar 30; the loose end of strap 52 may be connected to connection opening 54 and tightened, whereby hybrid training panel 12 is firmly connected to goal 20. Straps 52 may be pre-attached to the side extensions 44 of the cover portion 14 for connection to side posts 28 of goal 20, or may be attached as disclosed above.

Figure 17:
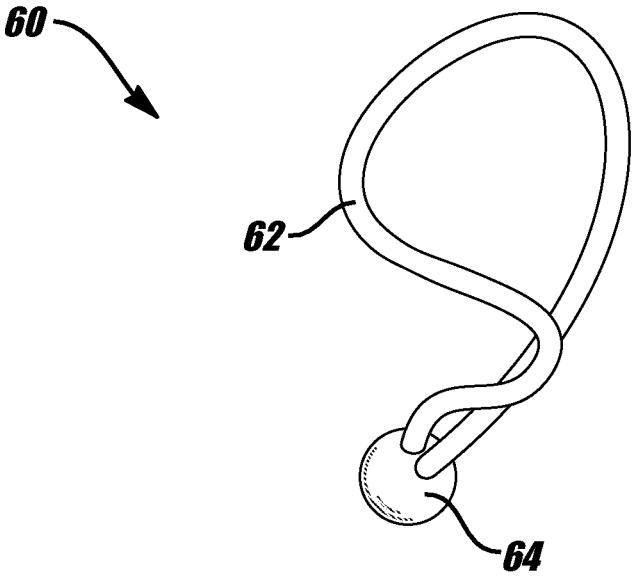
FIG. 17 is a perspective view of an exemplary embodiment of an attachment mechanism and in accordance with the present disclosure.
Figure 18:
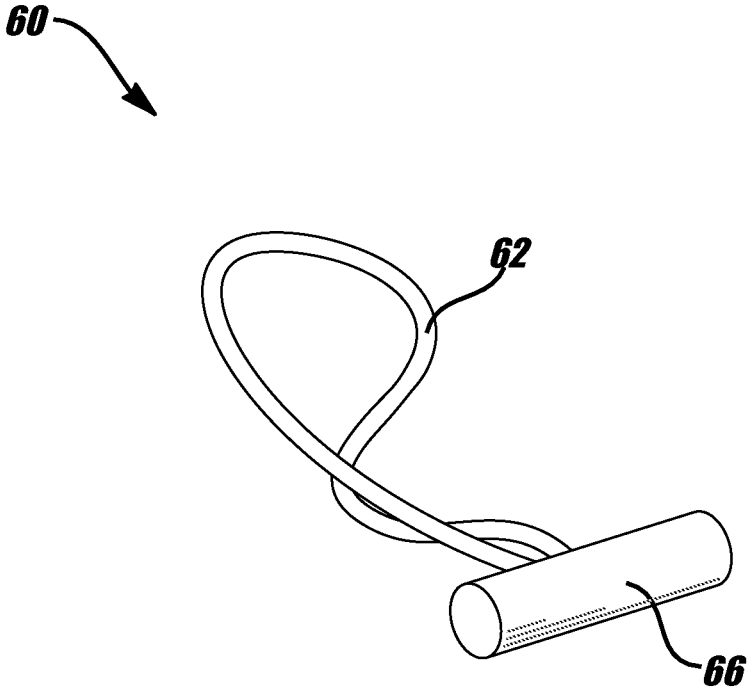
FIG. 18 is a perspective view of an exemplary embodiment of an attachment mechanism in accordance with the present disclosure.

With reference to FIGS. 17 and 18, another exemplary attachment mechanism 60 is configured to be affixed around a top bar of a goal and hold the hybrid goal shot training device in place relative to the goal. An exemplary attachment mechanism 60 includes a cord member 62 and a locking mechanism 64 slidably coupled to the cord member 62. More particularly, the cord member 62 forms a ring with the ends of the cord member inserted through the locking mechanism 64. Any type of cord and locking mechanism could be used so long as the attachment mechanism is strong enough to hold the goal shot training device onto a goal. Exemplary attachment mechanisms include a ball locking mechanism 64, as shown in FIG. 17, and a cylindrical locking mechanism 66, as shown in FIG. 18, or any other shaped component that can serve to lock the attachment mechanism to the goal posts as described herein.

In operation, the attachment mechanism 60 is inserted into openings in the top of the hybrid goal shot training device and is also connected to upper crossbar of the goal frame and optionally the side posts. Locking mechanism 64 or 66 is then drawn through the cord member 62 and the hybrid goal shot training device is allowed to hang down until the cord member 62 closes tightly around the locking mechanism 64 or 66, thereby securing the hybrid goal shot training device.

Exemplary embodiments include methods of conditioning soccer players to improve their shooting and increase the likelihood of successful shots on goal 20. The methods use positive viewing spaces 25 and negative viewing spaces 15 to condition players to shoot towards the areas of the goal 20 defined by the positive viewing spaces 25. More specifically, hybrid goal shot training device 10 is provided as discussed in detail above and includes both positive viewing spaces 25 and negative viewing spaces 15. Once installed on a goal 20 or a goal frame, players set up and shoot balls, pucks, or other objects towards the goal with the attached training device 10 or the training device 10 on the goal frame, aiming at the positive viewing spaces 25. In embodiments, a hybrid goal shooting training system 1 is used over an extended time to condition the player to look first to positive viewing spaces 25 of goal 20, even in the absence of the hybrid goal shot training device 10. As players practice using the hybrid goal shooting training system 1, they will become conditioned to shoot at the areas of goal 20 that are most likely to produce scores.

Moreover, according to the teachings of similar methods, providing goal shot training systems and devices to children and young adult athletes would improve their skills and make them more likely to be selected for specialized teams, play for college teams, earn scholarships, and to eventually become professional players. Thus, conditioning children and young adults to increase the likelihood of scoring goals using goal shot training systems and devices is an additional value imparted by the teachings of the present disclosure.

Thus, it is seen that hybrid goal shot training systems, devices and methods are provided. While the systems, devices, and methods have been described in terms of exemplary embodiments, it is to be understood that the disclosure need not be limited to the disclosed embodiments. Although illustrative embodiments are described hereinabove, it will be evident to one skilled in the art that various changes and modifications may be made therein without departing from the disclosure.

It should be understood that any of the foregoing configurations and specialized components or chemical compounds may be interchangeably used with any of the systems of the preceding embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims. It is intended in the appended claims to cover all such changes and modifications that fall within the true spirit and scope of the disclosure.

The invention claimed is:

1. A hybrid goal shot training device comprising:

a unitary hybrid training panel having a one-piece construction, the hybrid training panel including:

a substantially cross-shaped cover portion creating negative space by obscuring visual access behind the cover portion, the cover portion having a top edge, a bottom edge, a right side extension with a right side edge and a left side extension with a left side edge and four corners; and four net portions, each net portion being located at a respective corner of the cover portion with a first net portion located above the left side extension, a second net portion located below the left side extension, a third net portion located above the right side extension and a fourth net portion located below the right side extension, each net portion being integrally formed with the cover portion and meeting the cover portion at one of the corners and at a side extension such that the four net portions and the cover portion are substantially in the same plane, each of the four net portions defining multiple net openings and allowing visual access of positive space behind each of the four net portions such that there is a visual distinction between the cover portion and the four net portions.

2. The training device of claim 1 wherein the cover portion is of a color that creates a visual contrast with the four net portions.

3. The training device of claim 1 further comprising a band of brightly colored material located where each of the four net portions is connected to the cover portion.

4. The training device of claim 1 wherein the cover portion is composed of a knit material defining multiple knit openings.

5. The training device of claim 1 wherein the four net portions are substantially quarter circle shaped and the right and left side extensions have concave edges.

6. A hybrid goal shooting training system, comprising:

a hybrid training panel adapted to be used in combination with a goal frame;

the hybrid training panel including:

a substantially cross-shaped cover portion composed of a material creating negative space by obscuring visual access behind the cover portion, the cover portion having a top edge, a bottom edge, a right side extension with a right side edge and a left side extension with a left side edge and four corners; and four net portions, each net portion being located at a respective corner of the cover portion with a first net portion located above the left side extension, a second net portion located below the left side extension, a third net portion located above the right side extension and a fourth net portion located below the right side extension, each net portion being connected to the cover portion and meeting the cover portion at one of the corners and at a side extension such that the four net portions and the cover portion are substantially in the same plane, each of the four net portions defining multiple net openings and allowing visual access of positive space behind each of the four net portions such that the negative space of the cover portion and the positive space of the four net portions create a visual distinction between the cover portion and the four net portions;

the hybrid training panel being connected to the goal frame in place of a net.

7. The training system of claim 6 wherein the hybrid training panel is a unitary device having a one-piece construction.

8. The training system of claim 6 wherein the material is a knit material defining multiple knit openings.

9. The training system of claim 8 wherein the knit openings are substantially teardrop-shaped or substantially egg-shaped.

10. The training system of claim 6 wherein the material is of a color that creates a visual contrast with four net portions.

11. The training system of claim 6 further comprising a net affixed to the goal frame, wherein the cover portion obscures a majority of the net from view.

12. The training system of claim 6 further comprising a fifth net portion connected to the cover portion.

13. The training system of claim 6 wherein the hybrid training panel is connected to a flat goal frame in place of a net that would be connected to the flat goal frame.

14. The training system of claim 6 wherein the hybrid training panel is connected to one or more rear portions of a goal frame in place of a net that would be connected to the rear goal frame.

15. The training system of claim 6 wherein the four net portions are substantially quarter circle shaped and the right and left side extensions have concave edges.

16. A hybrid goal shot training device comprising:

a unitary hybrid training panel having a one-piece construction, the hybrid training panel including:

a cover portion composed of a material having a first color and creating negative space by obscuring visual access behind the cover portion, the cover portion being substantially cross-shaped and having a top edge, a bottom edge, and side edges, and four corners; and four net portions, each net portion being located at a respective corner of the cover portion and being integrally formed with the cover portion and meeting the cover portion at one of the corners such that the net portion and the cover portion are substantially in the same plane, the net portion being of a second color allowing visual access of positive space behind the net portion, the first color being darker than the second color such that the cover portion creates a visual distinction between the cover portion and the at least one net portion.

17. The training device of claim 16 wherein the material is a knit material defining multiple knit openings.

18. The training device of claim 16 further comprising a band of brightly colored material located where each net portion is connected to the cover portion.

19. The training device of claim 16 wherein the four net portions are substantially quarter circle shaped and the right and left side extensions have concave edges.

* * * * *